US010808464B2

(12) United States Patent
Urquhart

(10) Patent No.: US 10,808,464 B2
(45) Date of Patent: Oct. 20, 2020

(54) CABLE GUIDE FOR DRILL LINE SLIP AND CUT OPERATIONS ON A DRILLING RIG AND RELATED METHOD FOR ACHIEVING A TENSIONED STATE OF THE DRILL LINE

(71) Applicant: Jesse Urquhart, Edmonton (CA)

(72) Inventor: Jesse Urquhart, Edmonton (CA)

( * ) Notice: Subject to any disclaimer, the term of this patent is extended or adjusted under 35 U.S.C. 154(b) by 191 days.

(21) Appl. No.: 15/749,308

(22) PCT Filed: Jul. 29, 2016

(86) PCT No.: PCT/CA2016/050893

§ 371 (c)(1),
(2) Date: Jan. 31, 2018

(87) PCT Pub. No.: WO2017/020122

PCT Pub. Date: Feb. 9, 2017

(65) Prior Publication Data

US 2018/0230760 A1 Aug. 16, 2018

Related U.S. Application Data

(60) Provisional application No. 62/199,544, filed on Jul. 31, 2015.

(51) Int. Cl.

| | |
|---|---|
| ***E21B 19/083*** | (2006.01) |
| ***E21B 19/22*** | (2006.01) |
| ***E21B 19/24*** | (2006.01) |
| ***B66D 1/36*** | (2006.01) |
| ***E21B 19/08*** | (2006.01) |
| *E21B 15/00* | (2006.01) |

(52) U.S. Cl.
CPC ..... *E21B 19/083* (2013.01); *B66D 1/36* (2013.01); *E21B 19/08* (2013.01); *E21B 19/22* (2013.01); *E21B 19/24* (2013.01); *E21B 15/00* (2013.01)

(58) Field of Classification Search
CPC ..... E21B 15/00; E21B 19/08; E21B 19/083; E21B 19/22; E21B 19/24; B66D 1/36
See application file for complete search history.

(56) References Cited

U.S. PATENT DOCUMENTS 1,598,802 A * 9/1926 Brown ..... B66D 1/36 254/397
1,649,184 A * 11/1927 Posey ..... B66D 1/36 242/157.1

(Continued)

*Primary Examiner* — Daniel P Stephenson
(74) *Attorney, Agent, or Firm* — Kyle R. Satterthwaite; Ryan W. Dupuis; Ade & Company Inc.

(57) ABSTRACT

A cable guide for supporting a slack portion of a drill line during a slip and cut operation features a top body portion and a bottom body portion held together in spaced relation to one another such that inner ends of the top and bottom body portions are facing but spaced from one another. At least one contact surface is carried on each body portion, and a pair of the contact surfaces are aligned in a working position so as to collectively define a pathway between the inner ends of the top and bottom body portions along which the slack portion of the drill line is to be routed. The cable guide also features an adjustable coupling mechanism arranged for displacing the inner ends of the top and bottom body portions towards and away from one another so as to adjust a size of the pathway.

20 Claims, 13 Drawing Sheets

(56) References Cited

U.S. PATENT DOCUMENTS

| | | | | |
|---|---|---|---|---|
| 4,271,908 | A * | 6/1981 | Robinson, Jr. | E21B 23/14 166/385 |
| 9,702,208 | B2 * | 7/2017 | Urquhart | E21B 19/24 |
| 2014/0166270 | A1 * | 6/2014 | Varkey | E21B 41/00 166/250.01 |
| 2014/0291030 | A1 * | 10/2014 | Urquhart | E21B 19/24 175/203 |
| 2016/0122163 | A1 * | 5/2016 | Krijnen | E21B 17/1035 254/389 |
| 2017/0225929 | A1 * | 8/2017 | Nielsen | B66D 3/06 |
| 2018/0230760 | A1 * | 8/2018 | Urguhart | E21B 19/08 |

* cited by examiner

CABLE GUIDE FOR DRILL LINE SLIP AND CUT OPERATIONS ON A DRILLING RIG AND RELATED METHOD FOR ACHIEVING A TENSIONED STATE OF THE DRILL LINE

This application is the national stage of PCT/CA2016/050893, filed Jul. 29, 2016, which claims benefit under 35 U.S.C. 119(e) of U.S. Provisional Patent Application No. 62/199,544, filed Jul. 31, 2015, the entirety of which is incorporated herein by reference.

FIELD OF THE INVENTION

The present invention relates generally to drilling rigs used in the oil and gas industry, and more particularly to cable guides for use in a slip and cut operation in which a new section of drill line is introduced from a storage reel to replace a length of used drill line being cut from the draw-works.

BACKGROUND

With reference to the prior art shown in FIG. 1, it is known in a slip and cut operation of the type mentioned above to support slack in the drill line at an overhead position elevated above the draw works while feeding a new section of drill line reeled off of the supply reel to replace used line that is being cut from the draw-works. For this purpose, it is known to use a sling of webbing material attached to an air tugger line or winch line as a cable guide through which the slack overhead portion of drill line passes upwardly before turning back downwardly into the mouth of the draw-works. The winch line, typically used as a hoist to aid in maneuvering of equipment around the drilling rig, hangs down from its winch that is mounted somewhere on the derrick or mast of the rig so as to suspend the sling at an elevation greater than that of the draw-works. However, this can create concern for rig personnel in the form of safety risks created by the uncertainty of when the closed loop formed by the sling might break open when the webbing material eventually gives way to the abrasion experienced under movement of the metal wire rope of the drill line over and through the sling.

Another safety concern arises in that rig workers sometimes find it necessary to use manual tools to 'hammer' the drill line into grooves provided for same in the draw-works drum, which can place the worker dangerously close to the moving parts of the draw-works.

U.S. patent application Ser. No. 14/192,076, which belongs to the applicant, describes several embodiments of cable guides which are suited for overhead support of the drill line during slip and cut operations.

Now, the applicant provides a unique solution for overhead support of the drill line and proper feeding of the new drill line into the draw-works of a drilling rig during slip and cut operations that may improve upon the cables guides of the applicant's prior application and other prior art devices of the like.

SUMMARY OF THE INVENTION

According to one aspect of the invention there is provided a cable guide for supporting a slack portion of a drill line of a drilling rig at an overhead position elevated above a draw-works of the drilling rig during a feeding of a new section of the drill line from a supply reel during a slip and cut operation in which a used section of the drill line is removed from the draw-works, the cable guide comprising:

a top body portion;

a bottom body portion fastened to the top body portion such that inner ends of the respective body portion are held in spaced relation facing one another;

at least one contact surface carried on each one of the top and bottom body portions;

a pair of the contact surfaces of the respective body portions being aligned in a working position so as to collectively define a pathway between the inner ends of the top and bottom body portions along which the slack portion of the drill line is to be routed;

an adjustable coupling mechanism arranged for displacing the inner ends of the top and bottom body portions towards and away from one another so as to adjust a size of the pathway.

The embodiments as described in more detail hereinafter may overcome the potential shortcomings of the prior art by providing two separate body portions which are spaced apart from one another so as to guide the cable between the inner ends of the body portions. As such, the spaced relation of the body portions may facilitate easier implementation of the remaining features of the present invention. In particular, the body portions may comprise wear members which are removably received in receptacles formed by the body portions, and at least one of the wear members may include a plurality of grooves which are respectively positionable in the working position. Also, one of the body portions may comprise a roller. Moreover, the slack portion of the drill line may be clamped in the pathway so as to tension the drill line between the cable guide and the draw-works for storing the drill line on the draw-works. By tensioning the drill line in this manner, workers may no longer need to 'hammer' the drill line into grooves of a rotary drum of the draw-works, which is one way in which a number of workers required to perform the slip and cut operation may be reduced and the operation made safer for the workers. Also, generally speaking, use of the cable guide may make the slip and cut operation more efficient.

Each contact surface may be defined by the inner end of the respective body portion. It will be appreciated that 'inner end' may refer to a part or side of the respective body portion which is disposed immediately opposite the other body portion so as to be facing the opposing inner end such that the respective inner end may not necessarily describe an extreme location on the respective body portion which is closest to the opposing body portion.

In one instance, the top and bottom body portions form receptacles which are held in the spaced relation so as to face one another and the cable guide includes a pair of wear members removably received in the receptacles so as to be replaceable, at least one of the wear members comprising at least one groove defining said at least one contact surface. In one instance, at least one of the wear members comprises a block which is rectangular in shape. In one instance, at least one of the wear members is held stationary relative to the respective receptacle within which it is received. In one instance, at least one of the wear members comprises a block having two main faces and a plurality of peripheral faces about a periphery of the block, and preferably said at least one groove of said at least one of the wear members is disposed in one of the peripheral faces and comprises a main groove portion curved inward of the peripheral face and edge groove portions along peripheral edges joining the main faces and the peripheral face. It is preferred that the edge groove portions are inclined between the respective main face and the main groove portion.

More generally stated, in one instance at least one of the top body portion and the bottom portion comprises a body having opposing outward-facing surfaces on either side of a peripheral surface which supports the contact surface thereon, the contact surface comprising an intermediate contact portion and edge contact portions on each side thereof so as to be along edges joining each outward-facing surface and the peripheral surface, the edge contact portions being inclined between the respective outward-facing surface and the intermediate contact portion such that the contact surface has sloped transitions between the intermediate contact portion and the respective outward-facing surface.

In one instance, said at least one contact surface of at least one of the top body portion and the bottom body portion comprises a plurality of contact surfaces which are spaced about a periphery of said at least one of the respective body portions such that each one of the plurality of contact surfaces thereof are respectively positionable in the working position. Preferably, the periphery of said at least one of the top body portion and the bottom body portion comprises a plurality of peripheral faces respectively locating a respective one of the plurality of contact surfaces.

In one instance, one of the top body portion and bottom body portion comprises a roller carrying the at least one contact surface of said one of the top body portion and bottom body portion. In one instance, another one of the top body portion and bottom body portion comprises a stationary block carrying the at least one contact surface of said another one of the top body portion and bottom body portion, and the roller is rotatably supported so as to be rotatable relative to the block. In one instance, said at least one contact surface of the roller spans circumferentially about the roller. In one instance, said at least one contact surface of the roller that spans circumferentially about the roller comprises a groove. In one instance, said one of the top body portion and the bottom body portion forms a receptacle and the roller comprises a roller body and a shaft disposed axially along the roller body that is releasably fastened to the receptacle such that the roller body is replaceable. The at least one coupler may comprise two couplers each of which is attached at one of the top body portion and the body portion so that the top and bottom body portions are supportable from the winch line at a generally common elevation, that is one body portion is horizontally beside the other. In one instance, the top body portion comprises at least one coupler for hanging from a winch line of the drilling rig in the overhead position and preferably the roller is received in the bottom body portion. When the roller is received in the bottom body portion and when said another one of the top body portion and bottom body portion comprises the block, it is preferred that the block is received in the top body portion.

In one instance, the adjustable coupling mechanism comprises a biasing assembly arranged for biasing the top and bottom body portions toward one another so as to effect clamping of the slack portion of the drill line between the pair of the contact surfaces thereby tensioning the drill line between the cable guide and the draw-works. A combination of the cable guide and the draw-works may include a supplementary line tensioning assembly comprising a roller supported at a position outward from a periphery of a rotary drum of the draw-works that is supported for rotation about a drum axis for winding and playing out the drill line, the roller being biased toward said periphery of the drum in order to further tension the drill line between the cable guide and the draw-works by impinging on the drill line therebetween. 'Impinge' as used in this specification refers to contact on an area or location of an object whose state has already been modified by another entity; this contact may be achieved by applying continuous pressure on the area or at the location on the object such that the contact is not necessarily by achieved by striking the object, and the contact may realize positive benefits on the state of the object (e.g., further tensioning the drill line may be desirable). In one instance, the top and bottom body portions are fastened by threaded fasteners engaging a flange of one at least of the top and bottom body portions and respective receptacles of another one of the top and bottom body portions and the biasing assembly comprises a resilient element disposed on each fastener between a head thereof and the flange such that tightening of the fastener effects the clamping of the slack portion of the drill line. In one instance, each one of the top and bottom body portions comprise the flange and the fasteners have a head at each distal end thereof such that each fastener carries two resilient elements between the respective head and flange in order to generate clamping pressure on the slack portion of the drill line at the top body portion and the bottom body portion. In one instance, the resilient element comprises a compression spring which is received over the fastener so as to be in concentric relation relative thereto. In one instance, the cable guide further includes a tension sensing device arranged to detect a tensioned state of the drill line between the cable guide and the draw-works. In one instance, the tension sensing device is disposed intermediate the coupler and the winch line. In one instance, the tension sensing device comprises a load sensor disposed in one of the top and bottom body portions that is arranged for detecting clamping pressure between the top body portion and the bottom body portion.

Preferably, at least one of the top body portion and the bottom body portion comprises a body of polymeric material. In one instance, the body of polymeric material comprises nylon. In one instance, the body of polymeric material comprises polyethylene for example ultra-high molecular weight polyethylene. In one instance, the body of polymeric material comprises polyurethane.

The combination of the cable and draw-works may further include a support arrangement for holding the top and bottom body portions at a distance from the rotary drum of the draw-works that is supported for rotation about the drum axis for winding and playing out the drill line, the support arrangement including at least one horizontally oriented track which is elongate along the drum axis and spaced from the rotary drum and a carrier movably coupled to said at least one track that supports the top and bottom body portions in movement along said at least one track. Preferably, the carrier supports the top and bottom body portions in an inclined orientation such that the pathway lies along a tangent of a periphery of the rotary drum for feeding the drill line onto the rotary drum. The carrier and said at least one track may comprise cooperatively shaped channels in sliding engagement with one another which maintain the top and bottom body portions in a fixed angular orientation relative to the at least one track. The carrier may comprise a tubular member slidably received over the at least one track and the carrier and said at least one track may comprise common transverse cross-sections so as to maintain the fixed angular orientation of the top and bottom body portions. In one arrangement, the at least one track comprises a pair of parallel tracks which are spaced apart in an upright plane and the carrier supports the top and bottom body portions such that the drill line is routed about the support arrangement. In one instance, the at least one track is coupled to a housing of the draw-works that rotatably carries the rotary drum and the housing comprises a securing arrangement at or adjacent each end of the at least one track that is arranged for releasably securing at least one of the top and bottom body portions such that the body portions are prevented from moving along the at least one track.

The combination of the cable guide and the draw-works may include a supplementary line tensioning assembly comprising a roller supported at a position outward from a periphery of the rotary drum and biased toward said periphery of the drum in order to press the drill line against said periphery of the rotary drum by impinging on the drill line between the cable guide and the rotary drum.

According to another aspect of the invention there is provided a cable guide for supporting a slack portion of a drill line of a drilling rig at an overhead position elevated above a draw-works of the drilling rig during a feeding of a new section of the drill line from a supply reel during a slip and cut operation in which a used section of the drill line is removed from the draw-works, the cable guide comprising:

a body comprising a top body portion and a bottom body portion that are fastened to one another, the top and bottom body portions forming receptacles which are held in opposite relation to one another;

a pair of wear members received in the receptacles so as to be held in the opposite relation to one another;

at least one groove in at least one of the wear members;

a pair of the grooves of the opposing wear members being aligned in a working position so as to collectively define a pathway between the wear members along which the slack portion of the drill line is to be routed;

wherein said at least one groove of said at least one of the wear members comprises a plurality of grooves which are spaced about a periphery of said at least one of the wear members such that each one of the plurality of grooves thereof are respectively positionable in the working position.

According to another aspect of the invention there is provided a cable guide for supporting a slack portion of a drill line of a drilling rig at an overhead position elevated above a draw-works of the drilling rig during a feeding of a new section of the drill line from a supply reel during a slip and cut operation in which a used section of the drill line is removed from the draw-works, the cable guide comprising:

a body comprising a top body portion and a bottom body portion that are fastened to one another, the top and bottom body portions forming receptacles which are held in opposite relation to one another;

a pair of wear members received in the receptacles so as to be held in the opposite relation to one another to collectively define a pathway between the wear members along which the slack portion of the drill line is to be routed;

wherein one of the wear members comprises a stationary block;

wherein another one of the wear members comprises a roller which is rotatably supported by the respective one of the receptacles so as to be rotatable relative to the block.

According to another aspect of the invention there is provided a cable guide for supporting a slack portion of a drill line of a drilling rig at an overhead position elevated above a draw-works of the drilling rig during a feeding of a new section of the drill line from a supply reel during a slip and cut operation in which a used section of the drill line is removed from the draw-works, the cable guide comprising:

a body comprising a top body portion and a bottom body portion that are fastened to one another, the top and bottom body portions forming receptacles which are held in opposite relation to one another;

a pair of wear members received in the receptacles so as to be held in the opposite relation to one another to collectively define a pathway between the wear members along which the slack portion of the drill line is to be routed;

wherein the top and bottom body portions are releasably fastened by threaded fasteners engaging a flange in one of the top and bottom body portions and respective receptacles in another one of the top and bottom body portions;

wherein a resilient element is disposed on each fastener between a head thereof and the flange such that tightening of the fastener effects clamping of the slack portion of the drill line between the wear members thereby tensioning the drill line between the cable guide and the draw-works.

According to another aspect of the invention there is provided a method of feeding drill line to a draw-works of a drilling rig including routing the drill line through a path of resistance that is located at a distance from the draw-works and provides sufficient resistance to movement of the drill line so as to achieve a tensioned state of the drill line between the draw-works and the path of resistance.

Preferably, the path of resistance comprises a clamping mechanism arranged for clamping the drill line thereby providing the resistance to the movement of the drill line so as to achieve the tensioned state thereof between the draw-works and the path of resistance.

Preferably, the method includes a step of providing a cable guide at said distance from the draw-works, the cable guide comprising:

a top body portion and a bottom body portion fastened to one another such that inner ends of the respective body portion are held in spaced relation facing one another;

the path of resistance being defined between the inner ends of the top and bottom body portions along which the drill line is routed;

an adjustable clamping mechanism arranged for displacing the inner ends of the top and bottom body portions towards and away from one another so as to adjust a size of the path of resistance;

the adjustable clamping mechanism also being arranged for biasing the top and bottom body portions toward one another so as to effect clamping of the drill line between the inner ends thereby providing the resistance to the movement of the drill line through the path of resistance and achieving the tensioned state of the drill line between the draw-works and the cable guide. Preferably, the method includes a step of displacing the inner ends of the top and bottom body portions towards or away from one another so as to achieve a desired tensioned state of the drill line for properly winding the drill line on the rotary drum of the draw-works. The method may include a step of detecting the tensioned state of the drill line between the draw-works and the cable guide. When the method includes the step of detecting the tension state of the drill line, it is preferred that the cable guide includes a tension sensing device arranged to detect the tensioned state of the drill line between the cable guide and the draw-works and the step of detecting the tensioned state comprises obtaining a reading from the tension sensing device.

All or any of the above features may be combined.

BRIEF DESCRIPTION OF THE DRAWINGS

Preferred embodiments of the invention will now be described in conjunction with the accompanying drawings in which.

In the drawings like characters of reference indicate corresponding parts in the different figures.

DETAILED DESCRIPTION

Figure 1:
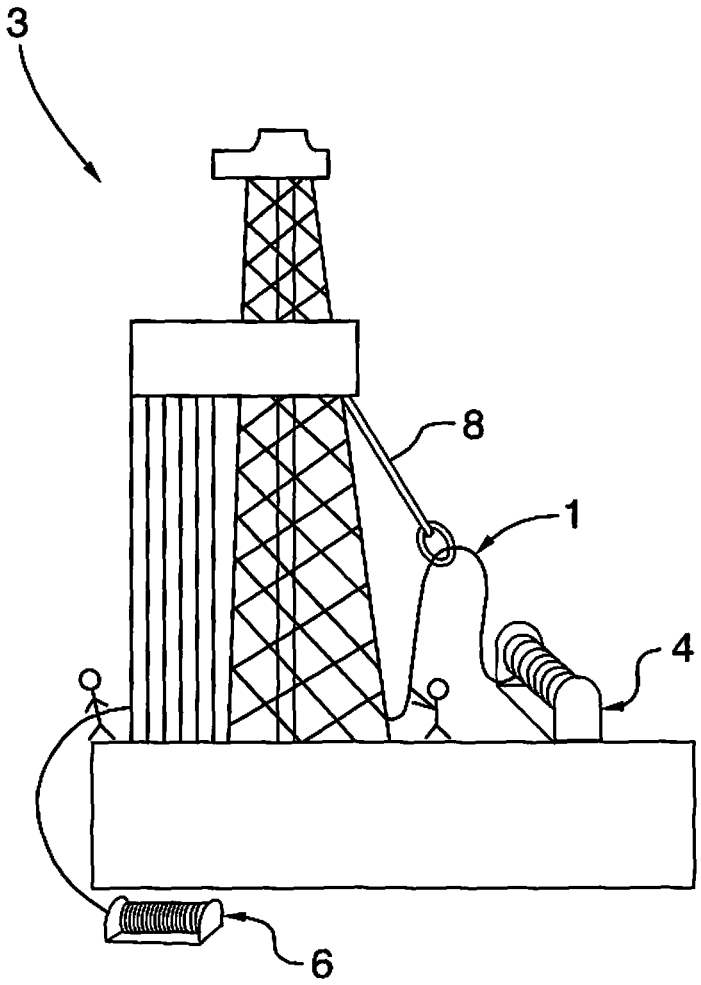
FIG.1 (PRIOR ART)
FIG. 1 schematically illustrates a drilling rig during performance of a slip and cut operation to spool a new section of drill line from a storage reel to replace a used length of the drill line that can thus be cut from the draw-works to remove this used length from service, and particularly illustrates prior art use of a fabric webbing sling to support a slack section of the drill line overhead of the draw works during this process.
Figure 2:
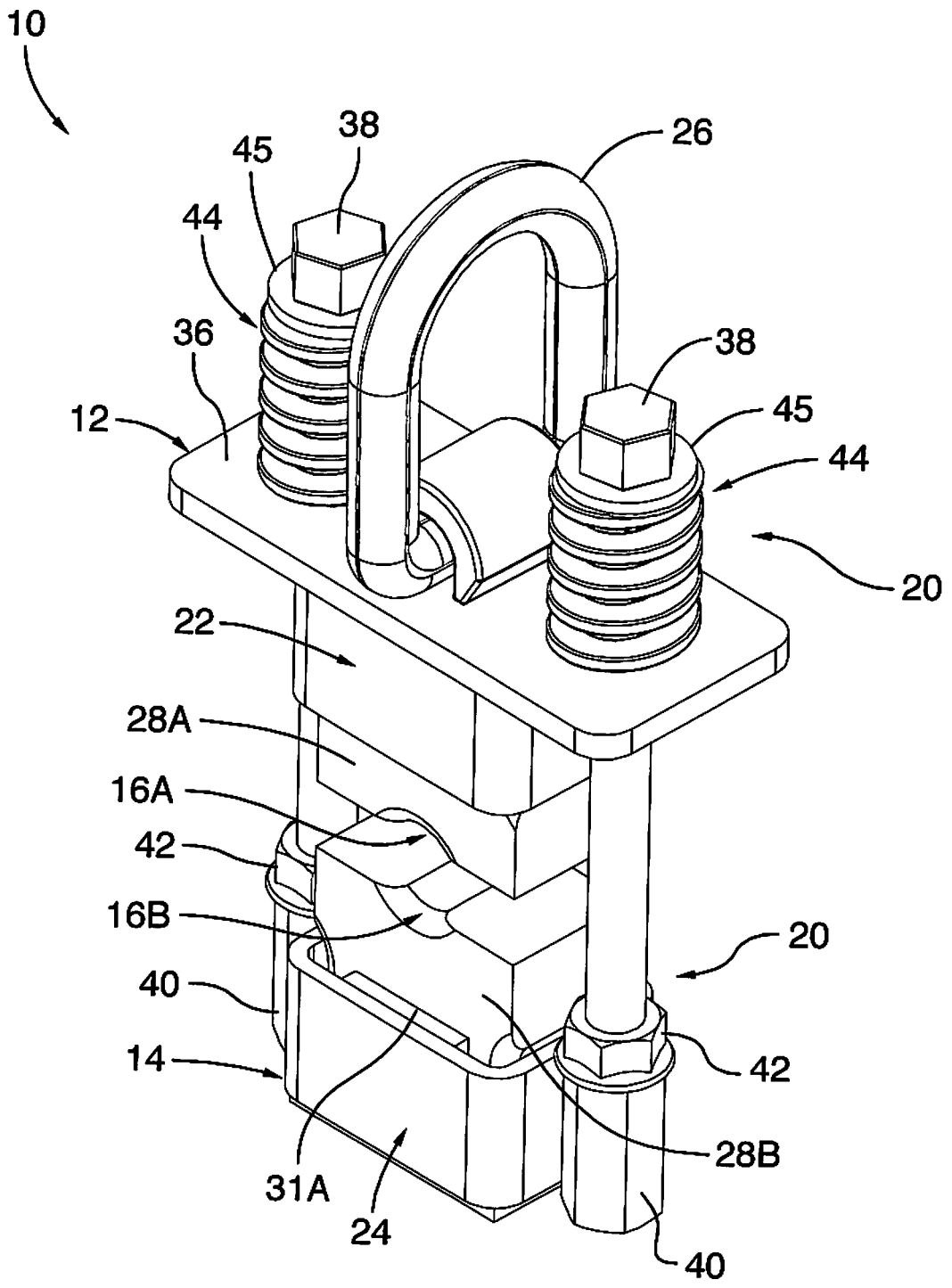
FIG. 2 is a perspective view of a first embodiment of cable guide according to the present invention.

Referring to the accompanying figures, there is illustrated a cable guide for supporting a slack portion 1 of a drill line of a drilling rig 3 at an overhead position elevated above a draw-works 4 of the drilling rig as shown in FIG. 1. The cable guide is especially suited for use during a feeding of a new section of the drill line from a supply reel 6 during a slip and cut operation in which a used section of the drill line is removed from the draw-works. Three preferred embodiments of the cable guide are illustrated and denoted 10, 10', and 10" respectively. Initially, parts which are common to the embodiments are described, followed by features which are unique to each embodiment.

Generally speaking, each cable guide of the illustrated embodiments comprises a top body portion 12 and a bottom body portion 14 which are separate from one another. The top and bottom body portions 12, 14 are fastened to one another such that inner ends 12A, 14A of the respective body portion are held in spaced relation facing one another as better shown in FIG. 3. Each one of the top and bottom body portions carries at least one contact surface labelled 16A, 16B for each of the top and bottom body portion respectively. A pair of the contact surfaces of the respective body portions are aligned in a working position so as to collectively define a pathway 18 between the inner ends 12A and 14A of the top and bottom body portions along which the slack portion 1 of the drill line is to be routed. Further to the forgoing, the cable guide 10 or 10' includes an adjustable coupling mechanism 20 arranged for displacing the inner ends 12A and 14A of the top and bottom body portions towards and away from one another so as to adjust a size of the pathway 18. Details of each of the aforementioned parts of the cable guide will now be described in relation to the particular embodiment.

In the first illustrated embodiment showing the cable guide 10, the top and bottom body portions 12, 14 form receptacles 22 and 24 which are held in the spaced and opposed relation so as to face one another. Each receptacle 22, 24 comprises a base 22A or 24A at an outer end of the respective body portion 12 or 14, a peripheral wall 22B or 24B supported on the base 22A or 24A extending inwardly toward the inner end 12A or 14A of the respective body portion, and an opening 22C or 24C delimited by a distal end of the peripheral wall that is opposite the base 22A or 24A. In addition, a coupler 26 is attached to the base 22A of the receptacle of the top body portion 12 for hanging from a winch line 8 of the drilling rig 3 in the overhead position. In the illustrated embodiment, the coupler 26 comprises an annular element pivotally mounted on the base 22A.

The cable guide 10 further includes a pair of wear members, each of which is respectively labelled 28A, 28B. Each wear member 28A or 28B is removably received in the respective receptacle so as to be replaceable. Each wear member comprises a block which is rectangular in cross-section along its thickness. For example, as in the illustrated embodiment, the block has a square cross-section. The block is made of a polymeric material such as nylon, polyethylene, or polyurethane which provides suitable wear resistance. One example of the nylon is nylatron, Nylatron is a trade name for a family of nylon plastics, typically filled with molybdenum disulfide lubricant powder. One example of the polyethylene is ultra-high-molecular-weight polyethylene (UHMW). Furthermore, the blocks 28A, 28B are held stationary relative to the respective receptacle 22 or 24 and relative to one another such that the blocks are subject to friction when the slack portion 1 of the drill line passes between the inner ends 12A and 14A of the blocks.

Each block 28A, 28B comprises two outward-facing main faces 30A and 30B and a plurality of peripheral faces 30C about a square periphery of the block. Note that in the illustrated embodiment each receptacle includes front and rear support elements 31A, 31B such as plates that are attached on inward-facing sides of the peripheral wall 22B or 24B so as to engage the main faces 30A, 30B of the respective block such that the block fits more snugly inside the receptacle. Peripheral edges 30D join the main faces 30A, 30B and the peripheral faces 30C along the periphery of the block. Furthermore, each block includes a plurality of grooves, each of which is located in a respective peripheral face 30C and centered therein. Each groove extends from one main face to the opposing main face. The grooves define the at least one contact surface 16A or 16B of the respective body portion. As such, each groove 16A, 16B comprises a main groove portion 32 which is curved inwardly of the peripheral face 30C. Each groove 16A, 16B also includes edge groove portions 34 respectively along each peripheral edge 30D between the respective peripheral face 30C and one of the main faces 30A or 30B of the block. The edge groove portions 34 are inclined between the respective main face 30A or 30B and the main groove portion 32 such that the groove is curved outwardly about a transverse axis through the block that is parallel to the respective peripheral face 30C. That is, the groove 16A, 16B has sloped transitions between the main groove portion 32 and the main faces 30A and 30B of the block. Thus, provision of the edge groove portions 34 may reduce potential detrimental effects of the slack portion 1 of the drill line moving directly against the peripheral edges 30D of the block such that the edge groove portions are suited for guiding the slack portion and controlling wear of the block due to the slack portion about a junction between the peripheral face 30C and the respective main face 30A, 30B.

Since each block 28A, 28B is removably received in its respective receptacle 22 or 24, the respective block may be rotated such that each peripheral face 30C is disposable at the inner end 12A or 14A of the respective body portion so that each groove or contact surface 16A, 16B of the respective body portion is positionable in the working position. Availability of multiple contact surfaces coupled with the ability to rotate from one to another may reduce costs in a long-term for oil or gas drilling companies who use the cable guide since each wear member may be considered due for replacement only once all of the contact surfaces thereon have been worn out.

Turning now to the coupling mechanism 20, the base 22A of the receptacle of the top body portion 12 extends laterally outward beyond the peripheral wall 22B of the receptacle so as to define a flange 36 of the top body portion. Threaded fasteners 38 such as screws or bolts pass through openings in the flange 36 that are disposed laterally of the receptacle 22 of the top body portion so as to be received in coupling receptacles 40 disposed laterally of the receptacle 24 of the bottom body portion 14. The fasteners 38 respectively threadably engage the respective coupling receptacle 40. A fastening element 42 such as a nut is threadably engaged on each fastener 38 so as to be suited for maintaining the spaced relation of the top and bottom body portions 12, 14 when the fastening element 42 is in abutment with a top of the respective coupling receptacle 40. Using the fasteners 38 and the fastening elements 42, the top and bottom body portions 12 and 14 may be displaced toward and away from one another. As such, the top and bottom body portions 12, 14 are releasably fastened to one another so that the body portions may be completely decoupled from one another by unthreading the fasteners 38 from the coupling receptacles 40. Additionally, the coupling mechanism 20 may hold the body portions 12 and 14 together such that the body portions may be moved sufficiently apart by relative rotation of one of the top and bottom body portions in respect of the other one thereof so that the cable guide can be received over the drill line. For example, unthreading one of the fasteners 38 from one of the coupling receptacles 40 would allow one body portion to be pivoted relative to the other about an axis of the remaining ones of the fasteners retaining the body portions together.

The coupling mechanism 20 also comprises a biasing assembly 44. The biasing assembly is arranged for biasing the top and bottom body portions 12, 14 toward one another so as to effect clamping of the slack portion 1 of the drill line between the pair of the contact surfaces 16A, 16B thereby tensioning the drill line between the cable guide 10 and the draw-works 4. The biasing assembly 44 comprises resilient elements 46 disposed on each fastener 38 between a head thereof and the flange 36 of the top body portion. In the illustrated embodiment, each resilient element comprises a helical compression spring which is received over the respective fastener 38 such that the spring is in concentric relation in respect of the respective fastener. A distribution plate 45 such as a washer is received on each fastener 38 at a location thereon intermediate the head of the respective fastener and the spring such that the head of the respective fastener engages the spring uniformly across a cross-section of the spring. Thus, by tightening of the fasteners, the slack portion 1 of the drill line in the pathway 20 may be clamped with varying clamping pressure on the slack portion while the compression springs 46 allow the pathway 20 to remain of a sufficient size so that the slack portion of the drill line is resisted from stopping in place between the contact surfaces 16A, 16B. In other words, the compression springs allow the slack portion to continue to pass through the pathway 20 without becoming stuck therein due to the clamping pressure of the body portions on the slack portion of the drill line. The biasing assembly 44 may be suited for tensioning the drill line between the cable guide and the draw-works 4 to a predetermined value to provide proper storage of the drill line in the form of winding the drill line onto a rotating drum 200 of the draw-works 4. For example, a rig worker may employ a torque wrench for tightening the fasteners 38 so as to correlate the torque on the wrench to the predetermined value for tension in the drill line. Tensioning of the drill line between the cable guide and the draw-works as described before is suited for pressing an incoming feed of the drill line against a periphery of the drum in order to help achieve a tensioned winding of the drill line tightly against the periphery of the drum. In the case of a grooved drum periphery where grooves in the drum define a predefined layout path for winding of the drill line onto the drum, tensioning of the slack portion as described before helps force the drill line into the grooves of the drum, thereby avoiding the need for manual assistance to this process by rig workers, thus increasing worker safety by keeping the workers away from the moving parts of the draw-works 4.

Figure 3:
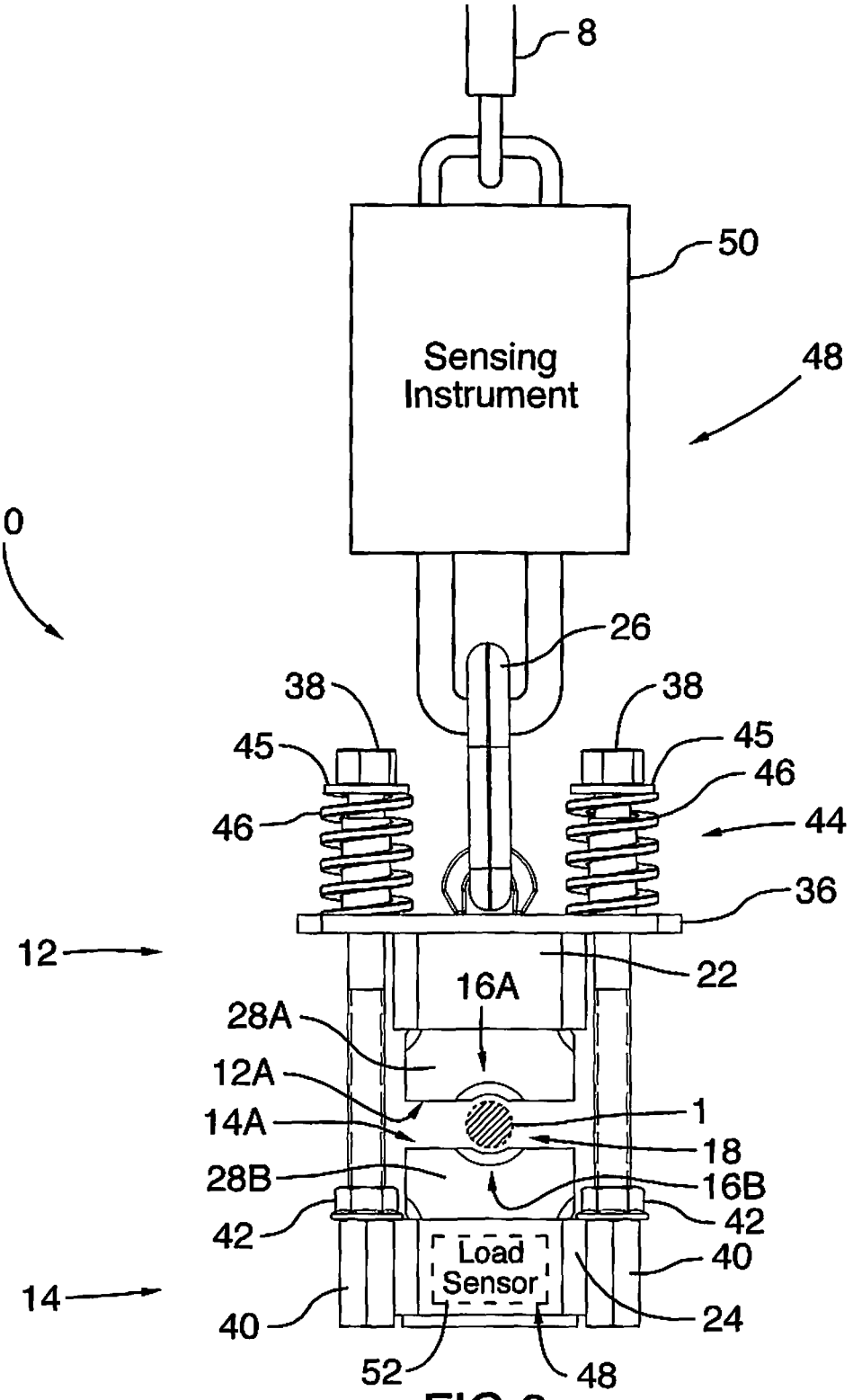
FIG. 3 is an elevation view from a front of the first embodiment of FIG. 2 but including a schematic illustration of a tension sensing instrument and a load sensor.
Figure 4:
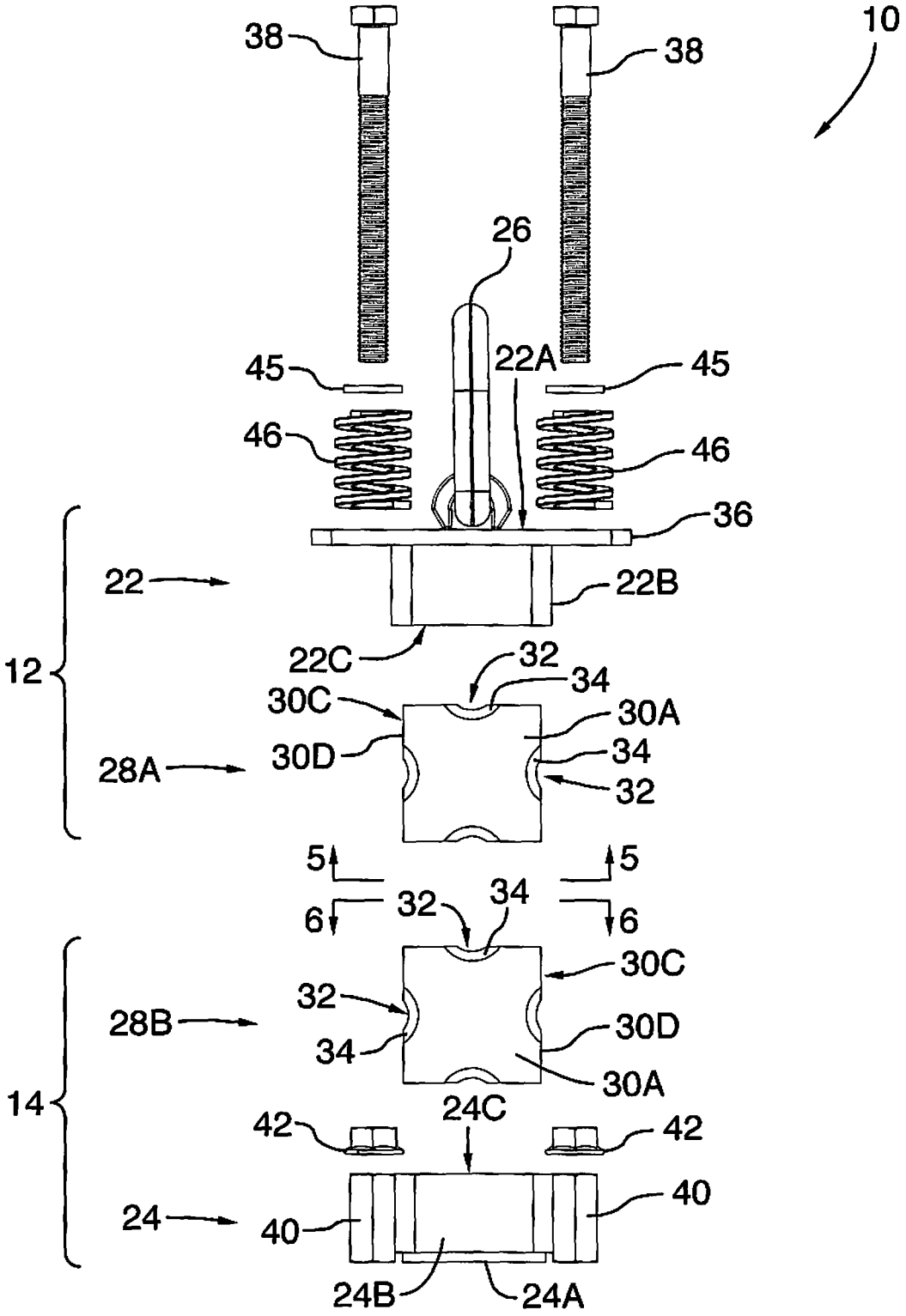
FIG. 4 is an exploded view of the first embodiment of FIG. 2.
Figure 5:
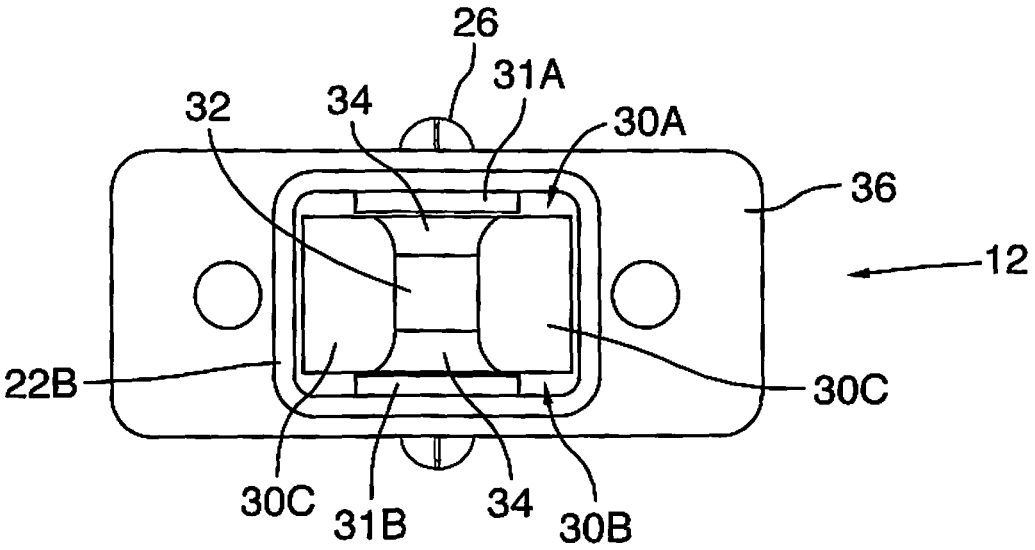
FIG. 5 is a cross-sectional view along line 5-5 in FIG. 4.
Figure 6:
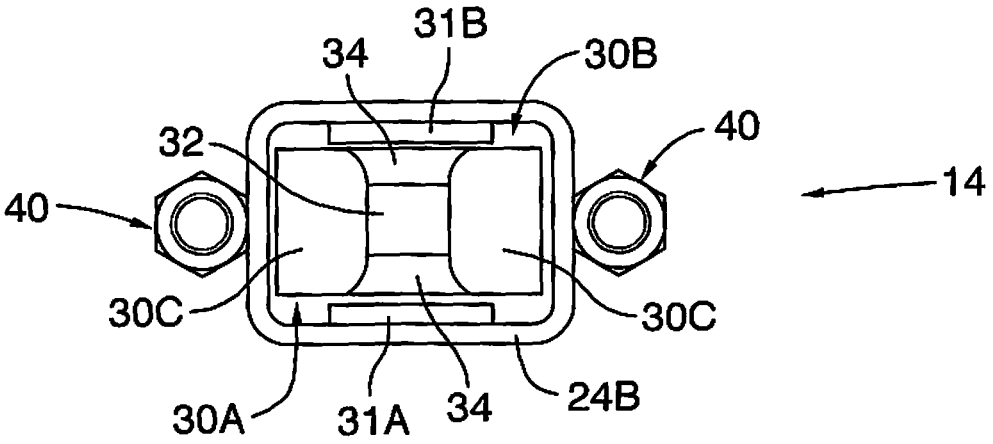
FIG. 6 is a cross-sectional view along line 6-6 in FIG. 4.
Figure 7:
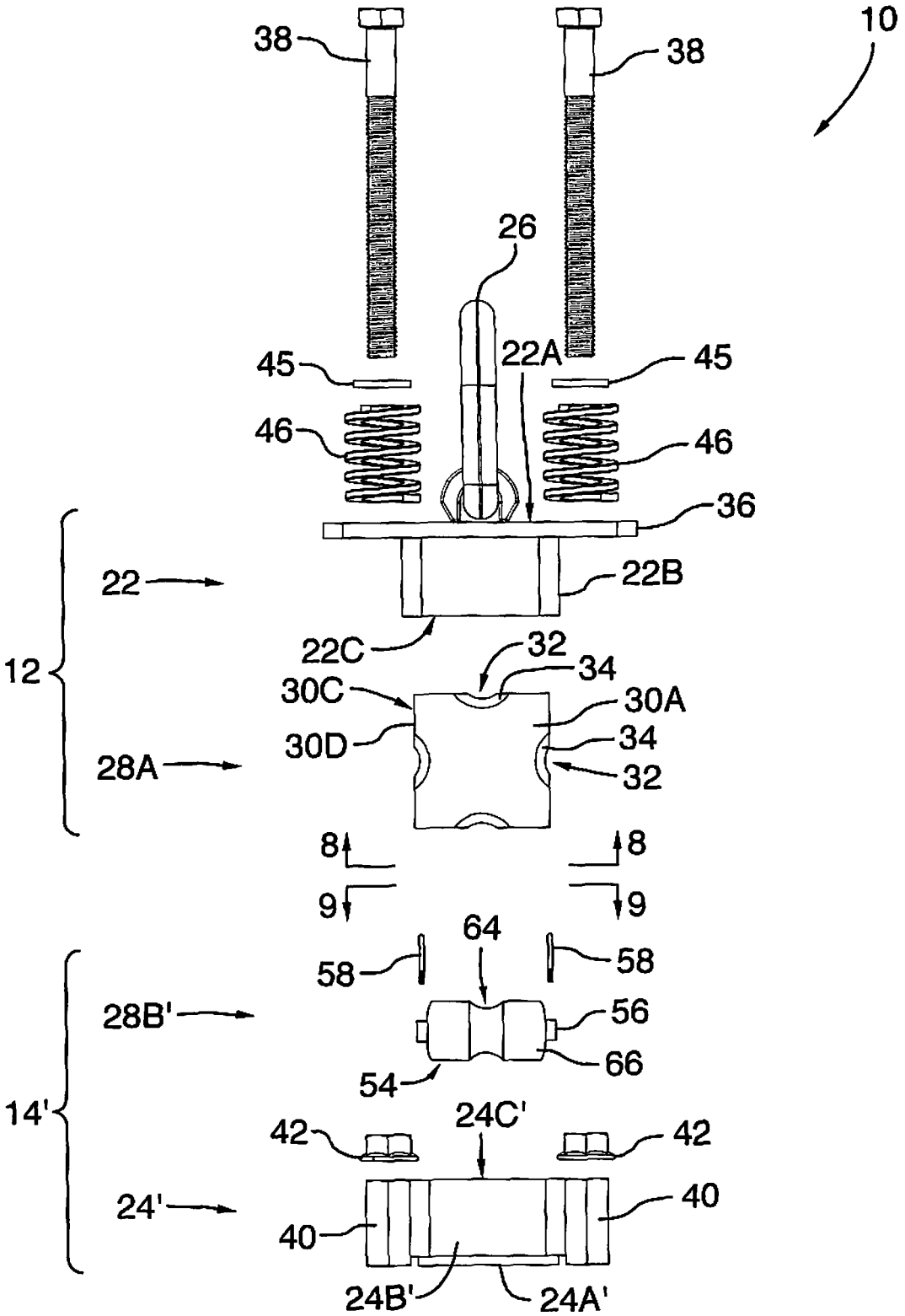
FIG. 7 is an exploded view of a second embodiment of cable guide according to the present invention.
Figure 8:
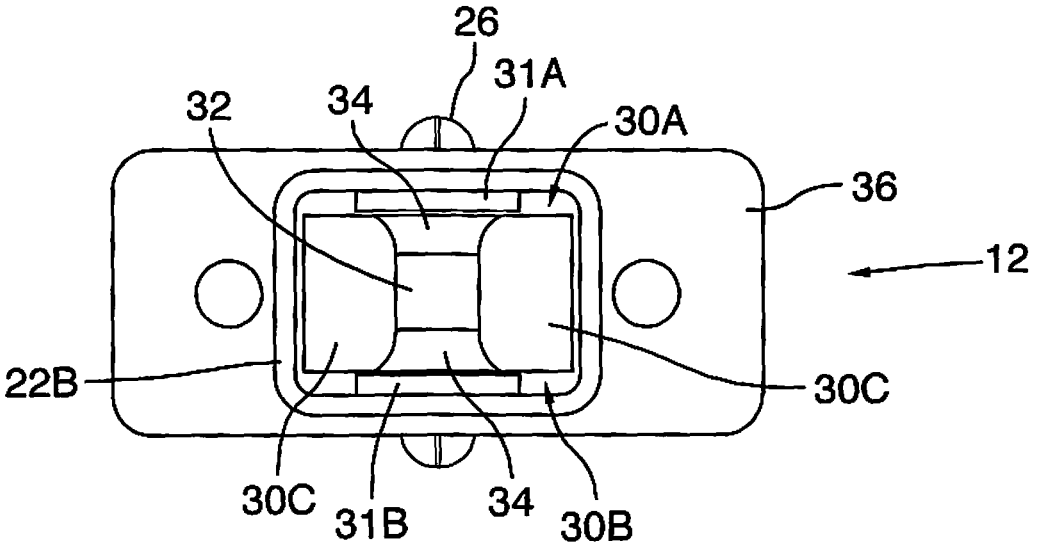
FIG. 8 is a cross-sectional view along line 8-8 in FIG. 7.
Figure 9:
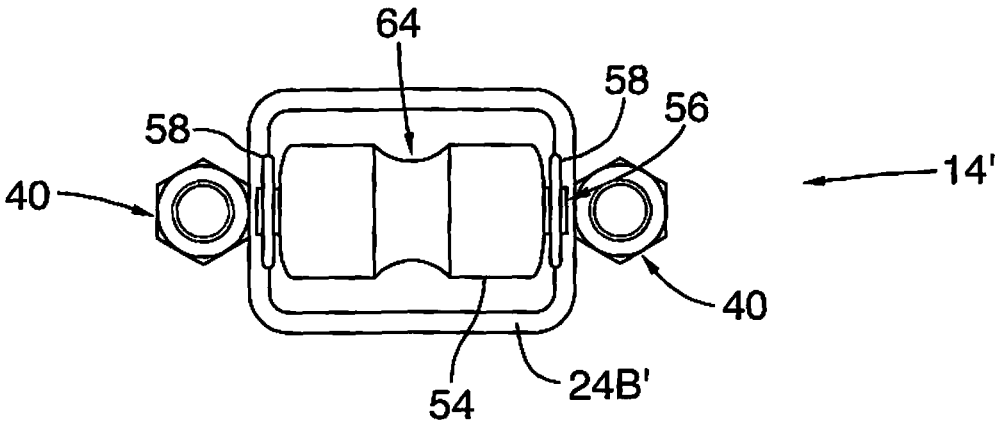
FIG. 9 is a cross-sectional view along line 9-9 in FIG. 7.
Figure 12:
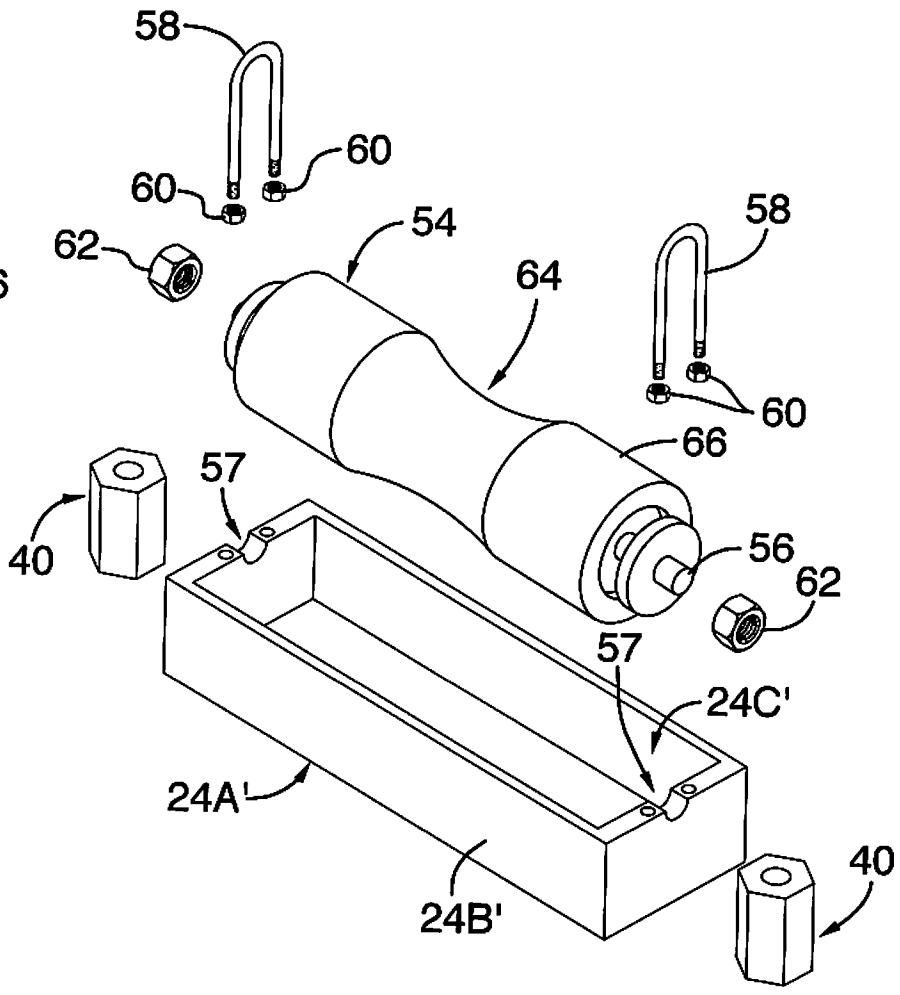
FIG. 12 is an exploded view of the bottom body portion of the second embodiment as shown in FIG. 10.
Figure 10:
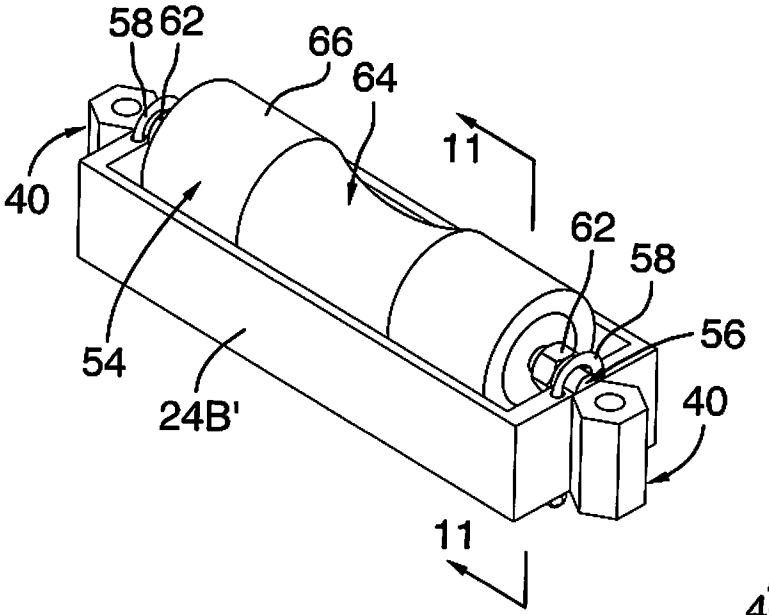
FIG. 10 is a perspective view of the second embodiment showing only a bottom body portion thereof so as to more clearly illustrate a roller of the second embodiment.
Figure 11:
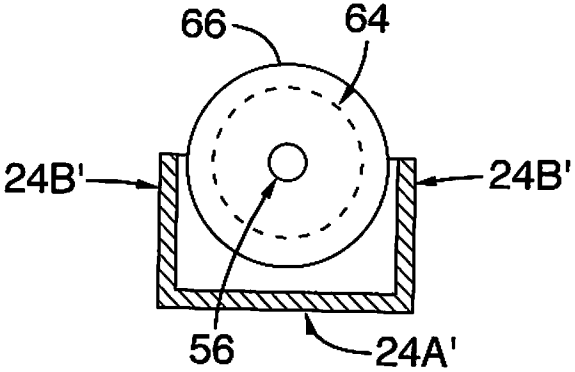
FIG. 11 is a cross-sectional view along line 11-11 in FIG. 10.

Further to the biasing assembly, the cable guide 10 also includes a tension sensing device 48 which is arranged to detect a tensioned state of the drill line between the cable guide and the draw-works. The tension sensing device 48 is suited for cooperative use with the biasing assembly 44 of the coupling mechanism such that the drill line between the cable guide and the draw-works may be tensioned to the predetermined value. For example, a standard impact wrench may be used for this purpose of tensioning instead of the torque wrench. The tension sensing device comprises a sensing instrument 50 that is schematically illustrated in FIG. 3 that is disposed intermediate the top body portion 12 and the winch line 8. For example, the sensing instrument 50 may be attached to the coupler 26 and the winch line 8 as in FIG. 3 and comprise a load cell so as to measure tension between the winch line 8 and the top body portion 12 to provide feedback on the tensioned state of the drill line, i.e., on how the drill line is being tensioned between the cable guide and the draw-works. A reading provided by the sensing instrument 50 may be monitored remotely at a distance away from a location of the cable guide 10 and the draw-works 4.

Alternatively or additionally to the sensing instrument 50, the tension sensing device 48 may comprise a load sensor 52 which is schematically shown in FIG. 3. The load sensor 52 is disposed in one of the top body portion 12 and the bottom body portion 14 so as to be in the receptacle 22 or 24 between the block 28A or 28B and the base 22A or 24A of the receptacle. The load sensor 52 is arranged for detecting clamping pressure on the slack portion 1 between the body portions 12, 14. The load sensor may comprise a load cell. Similar to the case of the sensing instrument 50, readings of the load sensor may be monitored remotely at a distance away from the location of the cable guide 10 and the draw-works 4 by, for example, using a hand-held or mounted display communicating with the load sensor 52 through a wired or wireless connection.

Turning now to the second embodiment of the cable guide that is labelled 10', this second embodiment 10' comprises all of that which the first embodiment 10 includes, albeit the bottom body portion is different in structure. That is, the block 28B of the bottom body portion 14 of the first embodiment is substituted for a roller 28B' that is rotatably supported in a receptacle 24' of a bottom body portion 14'. The receptacle 24' is slightly different in shape compared to that of the first embodiment so as to rotatably support the roller 28B' such that the roller is rotatable relative to the block 28A of the top body portion 12 that is stationary. More specifically, the roller 28B' is rotatable about an axis lying perpendicularly across the pathway 18. A remainder of the bottom body portion 14' is identical to that of the first embodiment. In particular, it is preferred that the roller 28B' is located in the bottom body portion because the drill line is fed downward of the cable guide to the draw-works 4 and the top body portion 12 comprises the coupler 26 for hanging from the winch line 8. The roller 28B' of the second embodiment may last longer in use as compared to the block of the first embodiment. However, the block 28A of the top body portion 12 remains so as to still allow clamping of the slack portion 1 of the drill line.

The roller 28B' comprises a roller body 54 which is made for example of nylon (e.g., nylatron) or UHMW and a shaft 56 disposed axially along the roller body 54. The shaft 56 is releasably fastened to the receptacle 24' of the bottom body portion 14'. In the illustrated embodiment, the shaft is carried on curved seats 57 in a peripheral wall 24B' of the receptacle 24'. Similar to the first embodiment 10, the peripheral wall 24B' is supported on a base 24A' and delimits an opening 24C' of the receptacle. As such, the roller body 54 is replaceable once worn out from use. In the illustrated second embodiment, the shaft 56 is fastened to the bottom body portion by a shaft fastening arrangement 58 such as U-bolts. In the illustrated embodiment, apertures in the peripheral wall 24B' receives the shaft fastening arrangement 58 therethrough, and fastening elements 60 secure the shaft fastening arrangement to the receptacle 24'. Spacing elements 62 such as nuts are received on the shaft at a location thereon that is intermediate the peripheral wall 24B' and the roller body for preventing engagement of the roller body with the peripheral wall 24B'. In other embodiments, the shaft fastening arrangement may comprise releasable clips.

The roller 28B', which is circular in circumference or cross-section, comprises a roller groove 64 defining the at least one contact surface of the bottom body portion of the second embodiment. The roller groove 64 is curved inwardly of a cylindrical peripheral surface 66 of the roller body and spans circumferentially about the roller 28B' so as to guide the slack portion 1 during rotational movement of the roller. In other embodiments, the roller may have a flat cylindrical periphery (i.e., so as to not include the roller groove) such that the contact surface of the bottom body portion 14' comprises a portion of a cylindrical peripheral surface of the roller that is aligned with the groove 16A in the wear member 28A of the top body portion 12 that is in the working position.

Figure 13:
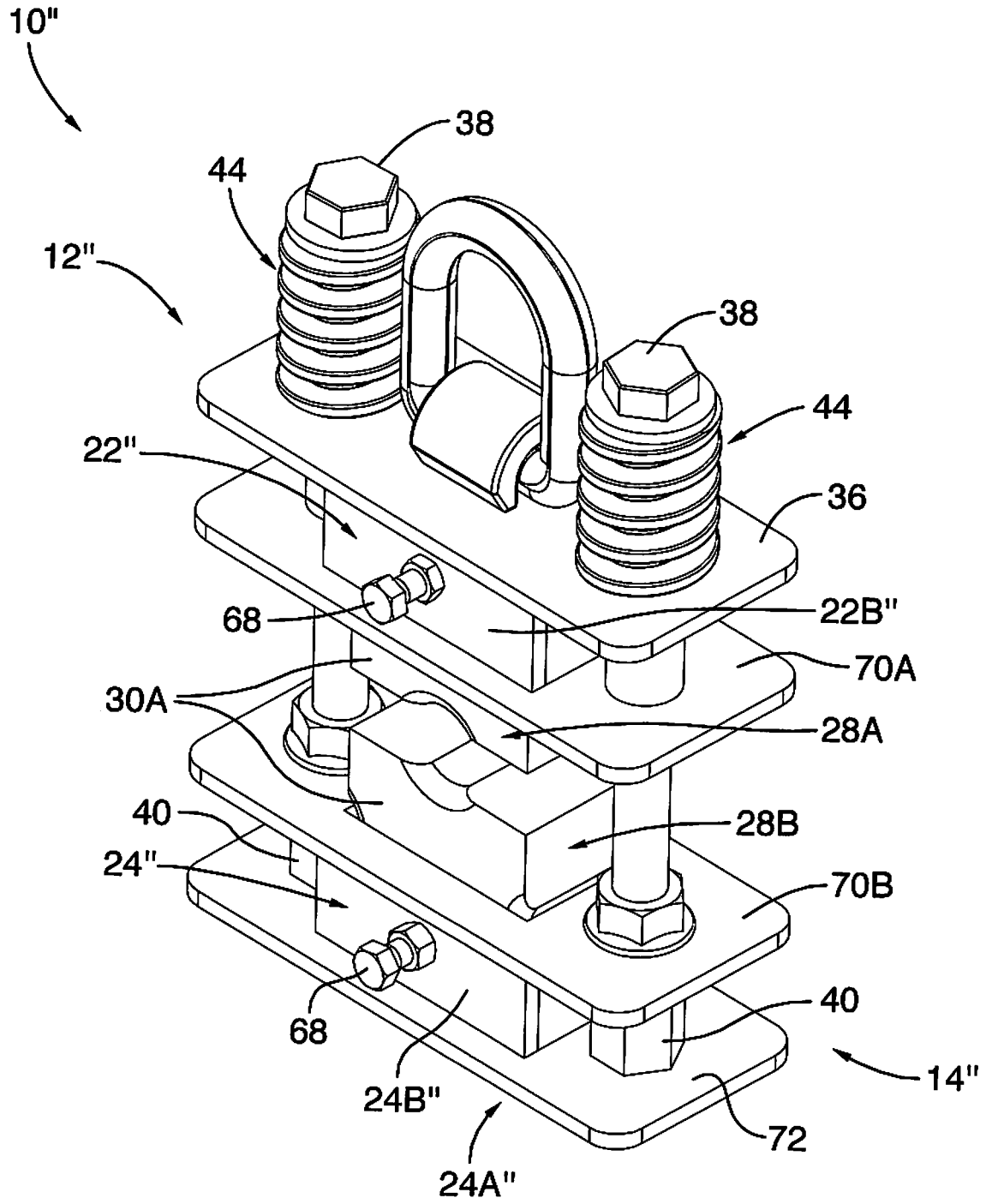
FIG. 13 is a perspective view of a third embodiment of cable guide according to the present invention.

Turning now to the third embodiment of the cable guide that is labelled 10" and shown in FIG. 13, this third embodiment 10" comprises all of that which the first embodiment 10 includes, albeit with some additional features and some structures which have been substituted for others as described hereinafter. For one, in lieu of the front and rear support elements 31A and 31B of the first embodiment, each receptacle 22", 24" of the third embodiment of the cable guide 10" comprises a receptacle clamping element 68 carried by a peripheral wall 22B" or 24B" for securing the respective wear member 28A or 28B within the receptacle. The receptacle clamping element 68 engages the respective wear member 28A, 28B at its main face 30A such that the receptacle clamping element places the wear member in butting engagement with a portion of the peripheral wall 22B", 24B" opposite to a location of the receptacle clamping element 68 in the peripheral wall. In the illustrated third embodiment, the receptacle clamping element 68 comprises a screw which is threadably carried in the peripheral wall 22B", 24B". Thus, the screw carries a movable clamping surface defined by its tip, and the portion of the peripheral wall opposite the location of the receptacle clamping element carries an opposing clamping surface cooperating with the movable clamping surface of the screw. Additionally, the receptacle clamping element is disposed so as provide clamping force to the wear member in a direction along a portion of the drill line passing through the pathway so as to be generally parallel to said portion of the drill line. Thus, the clamping force of the receptacle clamping element resists movement of the wear member longitudinally of the drill line. To provide sufficient clamping force for securing the wear member in the receptacle, the receptacle 22", 24" is sized and shaped to cooperate with a shape of the wear member as by, for example, a transverse or lateral cross-section of the wear member. That is, the receptacle 22", 24" includes a structural element or member for flush abutment with the wear member. In the illustrated embodiment, the peripheral wall 22B" or 24B" of the respective receptacle is shaped so as to have right-angled interior corners and a flat rear wall portion extending perpendicularly between the corners such that the main face 30A of the wear member fits snugly between a contact end of the receptacle clamping element 68 that engages the main face 30A and the peripheral wall 22B" or 24B". In alternative embodiments, the receptacle 22" or 24" may include a structural element such as the rear support element 31B as described in relation to the first embodiment 10.

Thus, overall, the receptacle clamping element provides functionality which is similar to that of the front and rear supports elements 31A, 31B of the first embodiment 10.

Further to the receptacle clamping elements, the third embodiment of the cable guide 10" includes auxiliary flanges 70A and 70B which may improve structural rigidity of the cable guide 10". Thus, each receptacle 22, 24 includes one auxiliary flange which is located at the distal end of the peripheral wall 22B, 24B and extends laterally outwardly therefrom. The auxiliary flange 70A of the top body portion 12" carries additional apertures for supporting the fasteners 38 at a location between the flange 36 and the coupling receptacles 40 so as to enhance the structural rigidity. The auxiliary flange 70B of the bottom body portion 14" provides support to the coupling receptacles 40 at a location between the flange 36 and terminal ends of the coupling receptacles. The auxiliary flanges are similar to the flange indicated at 36. Furthermore, the base 24A" of the receptacle of the bottom body portion 14" extends laterally outward beyond the peripheral wall 24B", like the flange indicated at 36 of the first embodiment 10, so as to form a bottom flange 72 and provide support to the coupling receptacles 40 at the terminal ends thereof.

In use, the cable guide is attached via its coupler 26 to the winch line 8 so as to be in the overhead position (shown in FIG. 1 of the prior art) at a distance from the draw-works. The cable guide is received over the slack portion 1 of the drill line by loosening and re-connecting the coupling mechanism 20, for example, as earlier described so that the slack portion of the drill line is routed through the pathway 18 of the cable guide. Once the drill line is routed through the pathway 18, the drill line may be clamped between the contact surfaces 16A, 16B that are in the working position by displacing the inner ends 12A, 14A of the body portions towards one another so as to constrict the pathway 18. The clamping pressure generated by the coupling mechanism 20 provides sufficient resistance to longitudinal movement of the drill line through the pathway 18 such that the drill line is tensioned between the cable guide and the draw-works, to which the drill line is fixed at or adjacent one of its ends. That is, the clamping of the drill line by the cable guide achieves the tensioned state of the drill line between the cable guide and the draw-works thereby providing the advantages associated with feeding a tensioned drill line onto a rotary drum of the draw-works 4 as discussed herein. Thus, the pathway 18 defines a path of resistance through which the drill line is routed and the clamping pressure on the drill line provides the sufficient resistance to the longitudinal movement of the drill line for tensioning the drill line, the tensioned state of which is generated or produced at a distance from the draw-works. The tension sensing device 48 may be used to detect the tensioned state of the drill line such as when, for example, a predetermined magnitude of the tensioned state of the drill line is required for proper winding of the drill line about the rotary drum of the draw-works. The tension sensing device 48 may also be used to monitor the tensioned state manually by periodically checking readings of the tension sensing device or automatically by the tension sensing device using algorithms known in the art for monitoring readings such as, for example, recording the readings at intervals of time and detecting whether the tensioned state satisfies a predetermined threshold required for proper operation. The tension sensing device 48 or another system to which the tension sensing device 48 is operatively coupled may provide indicators when the tensioned state does not meet the threshold such that the device 48 or system may advise corrective action for returning the tensioned state to a value satisfying the threshold.

Figure 14:
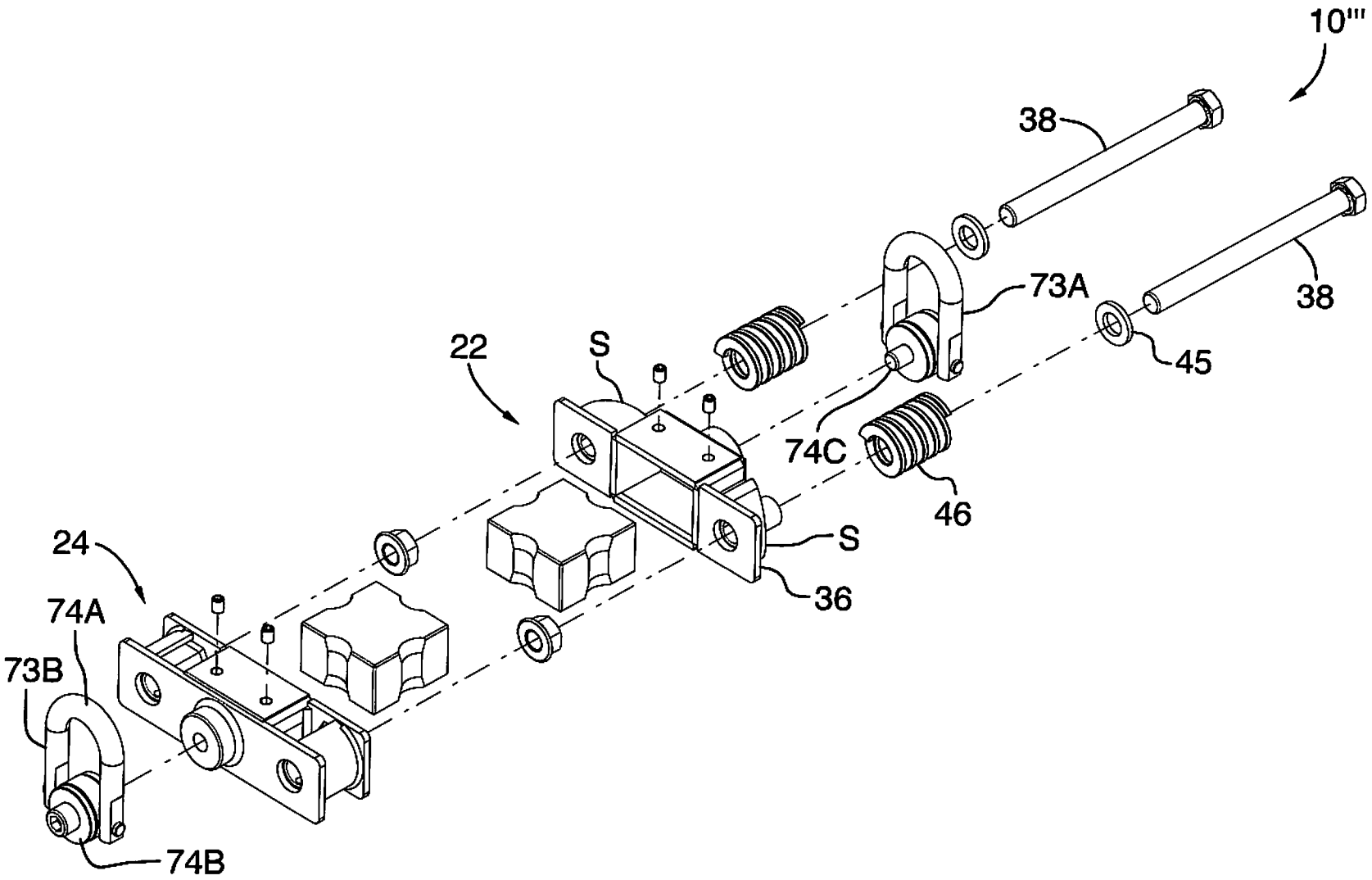
FIG. 14 is an exploded view of cable guide according to the present invention that is supportable in horizontal orientation over the draw-works.

As the cable guide is used, the wear members 28A or 28B may be rotated as deemed necessary by the worker(s) operating the drilling rig for switching to grooves which have not yet been worn out. In another variation of cable guide indicated at 10''' and shown in FIGS. 14-15 a pair of coupler 73A and 73B are provided at opposite ends of the cable guide thereto, that is one 73A at the top body portion 22 and the other 73B at the bottom body portion 24, so that the cable guide is supportable in horizontal orientation from winch line. In this case the winch line forms two strands 9A and 9B each having an end which is attached to the cable guide at one of the couplers 73A, 73B.

Each of the couplers 73A, 73B are similar in structure to the coupler 26 in that the respective coupler 73A, 73B forms a closed loop 74A defining in a plane. In the cable guide 10'', each loop 74A is mounted to a base body 74B forming a pin 74C extending perpendicularly transversely to the plane of the loop 74A. It is at the pin 74C that the coupler 73A, 73B connects to the respective one of the top body portion and the bottom body portion 22 or 24 at a cooperating receptacle therein, so that the loop 74A is held transversely of the body portion in order for the remainder of the cable guide to be held substantially horizontally connection to the winch line. As such, in the horizontal orientation each of the contact surfaces 16A and 16B are held at a generally common horizontal elevation, whereas in the vertical orientation as for example shown in FIG. 3 one contact surface 16A is held above and typically also over the other.

Horizontal orientation of the cable guide as more clearly illustrated in FIG. 15 may be particularly suited for use of the cable guide on a double/telescopic double type of drilling rig where the draw-works is located on the drilling rig at an elevation below a drill floor of the rig with minimal space around the draw-works such that the drill line is passed over top the draw-works and fed onto its rotary drum at a rear side thereof which is distal the derrick and facing away therefrom, Use of the cable guide in vertical orientation as illustrated more clearly in FIG. 3 may be particularly suited for drilling rigs of the triple type in which the draw-works is located on the drill floor of the rig and the drill-line may be fed onto the drum from a front side of the draw-works which is facing a drill string of the rig.

Figure 15:
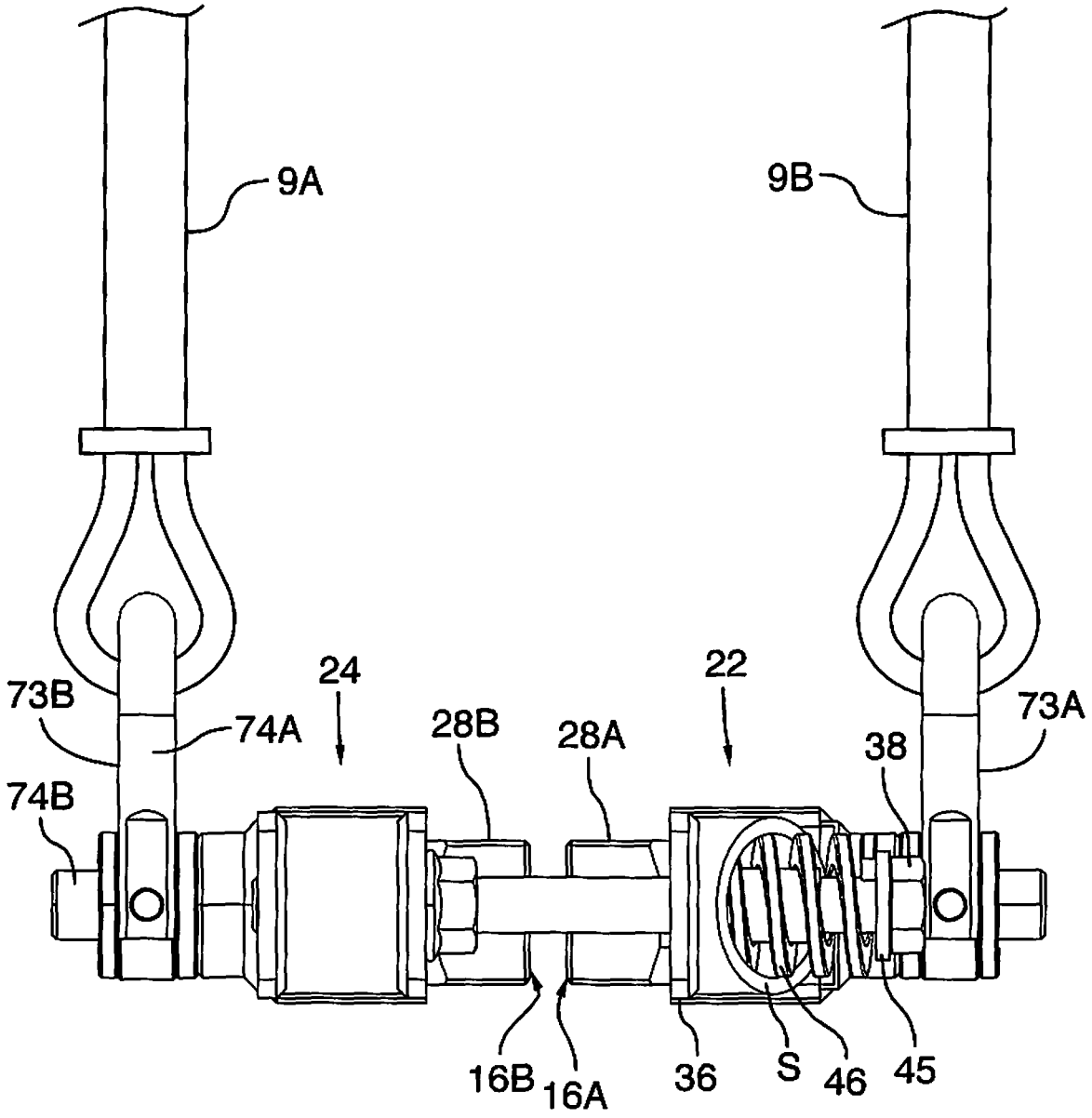
FIG. 15 illustrated the cable guide of FIG. 14 in side elevation.

FIG. 15 also illustrates a guide sleeve S which is supported on the flange of the top body portion at a location where the respective fastener 38 passes longitudinally through the top body portion. The guide sleeve S is tubular and extends longitudinally from the flange 36 towards the head of the respective fastener so as to peripherally enclose an axis of the respective resilient element 46, that is the compression spring. As such, the guide sleeve S acts to guide the resilient element 46 in its compression between the head of the fastener 38 and the flange 36 and thus maintain the resilient element in position therebetween.

Figure 16:
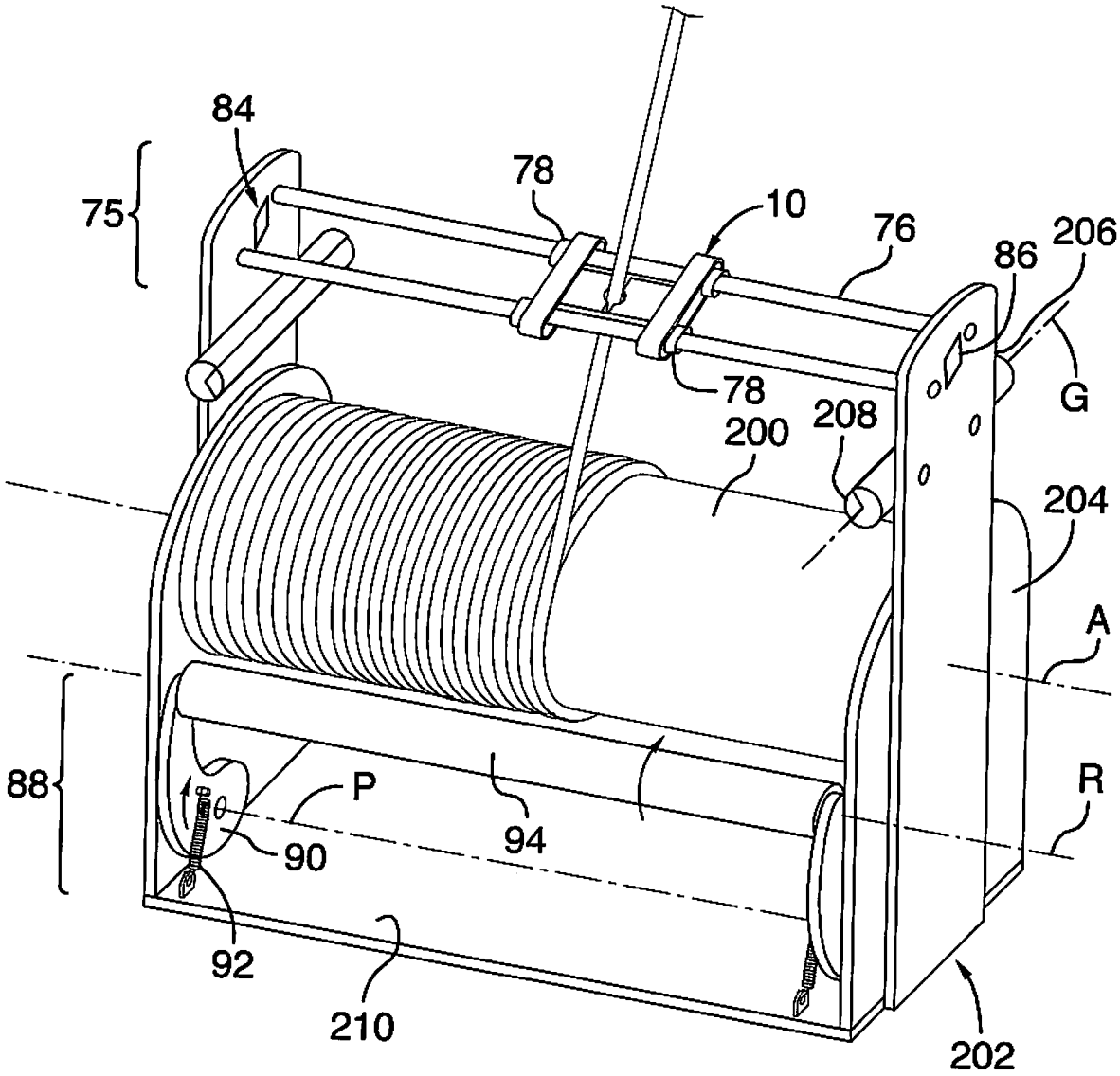
FIG. 16 illustrates a cable guide according to the present invention (schematically) supported in an inclined orientation by a carrier and a track system and also shows a supplementary line tensioning assembly on the draw-works.

In an alternative embodiment which is not shown, the cable guide FIG. 16 comprises a similar structure to the third embodiment of the cable guide except that both top and bottom body portions comprise flanges and at bases of receptacles of the top and bottom body portions. These flanges provide surfaces which are transverse to elongate fasteners extending in a longitudinal direction thereof between the top and bottom body portions so as to join same. Resilient elements such as compression springs may press against these transverse surfaces provided by the flanges such that the fasteners having a head at each distal end thereof carry one of the resilient elements between the respective head and the flange in order generate clamping pressure on the slack portion of the drill line both at the top and bottom body portions and. Thus, this alternative embodiment having two resilient elements on each fastener, may be capable of producing a greater combined clamping pressure on the drill line for producing a tensioned state which is larger than that possible by embodiments of the cable guide which have fewer resilient elements and which only generate the clamping pressure at one of the two body portions. That is, in the embodiment described in this paragraph clamping pressure is generated on either side of the drill line passing through the passageway of the cable guide.

It will be appreciated that the cable guide, regardless of specific embodiment, may be supported at a distance from the rotary drum 200 of the draw-works by a track system 75 as illustrated in FIG. 16 in lieu of hanging from the winch line 8. In this case, the cable guide does not require the coupler 26.

Turning briefly to the draw-works 4 in more detail, the drum 200 is supported for rotational movement on the draw-works about a drum axis A for winding and playing out the drill line, as is known in the art. A frame or housing 202 of the draw-works comprises upright walls 204 on which the rotary hoisting drum 200 is rotatably carried and upright supports 206 which extend upwardly beyond the upright walls 204. Each upright support 206 carries a winding guide roller 208 which is oriented transversely to the rotary drum 200 so as to be rotatable about a roller axis G that is transverse to the drum axis A. During winding or playing out of the drill line, the winding guide rollers 208 redirect the drill line in the opposite direction parallel to the drum axis A when the drill line reaches a distal end of the rotary drum 200 near the upright wall 204 so as to continue winding or playing out free of engagement with one of the upright walls of the draw-works.

Returning to the track system, the track system 75 comprises at least one track 76 which is horizontally oriented and spaced from the rotary drum 200 of the draw-works 4, typically at an elevation above the drum. Each track 76 is elongate in a direction along the drum axis A such that the each track is parallel to the drum axis. The track system 75 (which effectively refers to the collection of tracks irrespective of how many there are) is preferably at least as long as the rotary drum 200 in length along the longitudinal drum axis A such that tensioned winding of the drill line may be achieved along a full length of the drum. Also, the track system 75 may be supported at its distal ends externally of the draw-works such as by another structure on the drilling rig. Alternatively and potentially more conveniently, the track system 75 may be supported by the upright supports 206 of the draw-works above the rotary drum as shown in the illustrated embodiment.

Further to the track system 75, a carrier 78 is movably coupled to the track system 75 so as to be movable along the track system in a longitudinal direction thereof. The carrier supports the top and bottom body portions of the cable guide in movement along the track system. The carrier 78 may be arranged for one of rolling and sliding movement along the track system, for example, so long as the carrier is freely movable along the track system for carrying the cable guide in a direction parallel to the drum axis A during winding and playing out of the drill line. For example, the carrier may comprise a coating or lining on a surface of the carrier arranged for contact with the track(s) 76, such as nylon plastic, which reduces friction between the carrier and track system to provide the free movement of the carrier therealong. Although the carrier 78 is illustrated in FIG. 16 as an additional part in the form of tubes coupled to the top and bottom body portions, the carrier may also be a unitary component of the top and bottom body portions in other embodiments. For example, in accordance with a carrier which is arranged for sliding movement along the track system 75 as shown in FIG. 16, a unitary construction of the carrier may include extending the flanges 36 and 72 laterally outward and the carrier comprising tubular sleeve portions which extend in the longitudinal direction between the flanges 36 and 72.

Ideally, the track system and carrier hold the cable guide at an inclined orientation such that the pathway 18 lies along a tangent of a periphery of the rotary drum. This inclined orientation may reduce strain on the track system 75 and carrier 78 holding the cable guide as the cable guide clamps the drill line to tension it between the cable guide and the rotary drum 200. In the illustrated embodiment, the cable guide is supported such that its distal end 80 is at a lower elevation than a proximal end 82 of the cable guide which is closest in a horizontal direction to the drum axis A. In other embodiments, the distal end 80 may be positioned at a higher elevation than the proximal end 82 in order to align the pathway with a tangent of the periphery of the drum. (It will be appreciated that 'distal' as used in reference to the inclined orientation does not necessarily mean that the distal end of the cable guide is free or unattached. In a track system comprising two tracks, the distal end may be connected to one of the tracks but is nonetheless spaced further horizontally outward away from the drum axis A than another end of the cable guide at which the cable guide is attached.)

Moreover, the track system 75 and carrier 78 should maintain the cable guide at a fixed angular orientation relative to the track system such that the contact surfaces in the working position wear more evenly. For example, the steady angular orientation is achieved by cooperatively shaped channels of the track system and carrier that are in mating sliding engagement. More specifically, the track system 75 and the carrier 78 comprise common transverse cross-sections which resist rotation of the carrier angularly relative to the track system, which is especially critical when the track system has only one track in which case the cable guide is effectively cantilevered from a single track in the inclined orientation. In a simplest construction as shown in for example FIG. 16, the track system comprises a track channel such as a bar or tube (such that an inside of the channel may be solid or hollow), and the carrier comprises a tubular member which is slidable along an outer surface of the track channel. Since the cross-sections of the track sections match one another in shape and orientation, an appropriate polygonal shape having at least one vertex (i.e., any shape which is not entirely round) may be selected for the cross-sections to resist relative rotation of the tubular carrier channel in respect of the track channel. For example, the appropriate polygonal shape may include diamond, square, triangular, and tear-drop shaped cross-sections.

The track system may comprise two tracks which are spaced both horizontally and vertically apart from one another so as to hold the cable guide in the inclined orientation between the two tracks, as shown in FIG. 16. In this instance and using the construction of track system and carrier that includes the tubular member which is slidable along the outer surface of the closed channel, both the tracks and carrier may be round in cross-section since the cable guide is attached at two locations thereon so that angular rotation relative to either track by virtue of the cross-sectional shape may no longer be possible. Furthermore, it will be appreciated that the two tracks are sufficiently spaced apart such that the drill line may be safely routed between the tracks when using the cable guide (since the pathway is situated between the tracks) and also when the cable guide is not in use where the top and bottom body portions are separated from one another by a distance typically much greater than a thickness of the drill line. In this separated condition each body portion is typically arranged at the respective one of the upright supports 206 of the draw-works.

In another example, a pair of parallel horizontal tracks are spaced apart in a vertically upright plane so that the drill line is routed about the track system and carrier. The single track arrangement also allows the drill line to be routed about the track system and carrier.

For example, with reference to the rolling movement of the carrier along the track system, the carrier may comprise rolling wheels which are rotatably supported on a body frame defining a housing for the rolling wheels and which is connected to the cable guide. In such an arrangement the track system may comprise rolling surfaces defined for example by an I-beam and elongated along the drum axis A for carrying the rolling wheels and body frame and thus the cable guide in rolling movement along these surfaces in directions parallel to the drum axis A.

When the cable guide supported by the track system 75 and carrier 78 is not required for use such as for an extended period of time, a securing arrangement 84 at the upright supports 206 of the draw-works 4 releasably secures the cable guide away from the drill line once the line has been freed from between the top and bottom body portions so as to prevent the body portions from moving along the track system in a manner which may interfere with the drill line. (For example, movement which may be induced by vibrations of the draw-works.) The securing arrangement 84 schematically shown in FIG. 16 comprises a fastening feature 86 such as a sufficiently powerful magnet (e.g., rare earth magnet) which by magnetic attractive forces releasably attracts and holds with the top and bottom body portions which comprise bodies of metal; a latch cooperating with a latchable portion of the cable guide; or a hook in a fixed position for hooking around a projecting feature of the cable guide or hooking onto a recessed area of the cable guide. One fastening feature 86 may be disposed at each upright support 206 such that the cable guide may be stored to one end or the other away from the longitudinal center of the hoisting drum 200. Moreover, depending upon the configuration of the track system 75 and the carrier 78, ability to completely decouple the top and bottom body portions allows for each of the top and bottom body portions to be stored individually of one another in a separated condition of the cable guide where the top and bottom body portions are spaced apart by a substantial distance, typically much greater than the thickness of the drill line.

When the cable guide is required for use again, the cable guide whether intact or in the separated condition may be released from the fastening features 86 and the fasteners 38 threaded to join the body portions in the spaced condition for routing the drill line through the pathway 18.

As such, the cable guide of the various illustrated embodiments may be used on its own to guide the drill line onto the periphery of the hoisting drum 200 as the cable guide is alone capable of generating a tensioned state usable for winding the drill line onto the drum.

Additionally, the draw-works may be further modified from a conventional arrangement by the addition of a supplementary line tensioning assembly 88. The assembly 88 features a pair of support brackets 90 that are pivotally mounted to the frame 202 of the draw-works to allow pivoting of the two brackets 90 about a pivot axis P that is parallel to the longitudinal rotation axis A of the hoisting drum 200. In the illustrated embodiment, the brackets 90 are pivotally coupled to upright walls 204 of the draw-works 200 on which the hoisting drum 200 is also rotatably carried, but the bracket may alternatively be pivotally carried on a floor panel 210 of the draw-works frame 202 or another suitable support situated proximate the hoisting drum 200. A compression spring 92 for each bracket 90 has one end attached to the bracket at a radial distance from the pivot axis P and the other end attached to the floor panel 210 or another fixed point elsewhere on the draw-works frame 202, for example on the respective one of the upright walls 204 thereof, so that the spring 92 acts to pivot the brackets 90 in a predetermined direction about the pivot axis P that opposes the rotational direction of the drum 200 during winding of the new drill line D onto the drum.

A cylindrical roller 94 has its opposing ends rotatably supported by the brackets 90 at distal ends thereof that are located opposite the pivotally mounted ends of the brackets 90. The roller 94 is rotatable relative to the brackets about a rotational axis R lying centrally longitudinal of the roller 94 and parallel to the drum axis A and the pivot axis P. The springs 92 bias the brackets 90 in a direction moving their distal ends toward the hoisting drum 200 in order to bias the roller 94 toward the drum's periphery, as more clearly shown schematically with solid-headed arrows in FIGS. 16 and 17. The brackets and their shared pivot axis are situated to the side of the drum from which the drill line wraps onto the drum so that the roller is biased toward the lower quadrant of the drum's periphery on this side. This spring biased roller thus presses the incoming feed of the drill line against the periphery of the drum at this front lower quadrant of the drum, as in the illustrated embodiment, in order to help achieve a tensioned winding of the drill line tightly against the periphery of the drum. In the case of a grooved hoisting drum periphery where grooves in the drum define a pre-defined layout path for winding of the drill line onto the drum, the spring-biased tensioning roller 94 helps force the drill line into the grooves of the drum, thereby avoiding the need for manual assistance to this process by rig workers, thus increasing worker safety by keeping the workers away from the moving parts of the draw-works.

The axial length of the single roller 94 in the illustrated embodiment spans the full axial length of the area of the drum 200 that is arranged to accommodate winding of the drill line thereon, whereby the roller 94 will always be in contact with the portion of the drill line being currently wound onto the drum. In other embodiments, more than one roller may be employed, each being carried by a respective pair of brackets and each spanning a respective portion of the axial length of the drum's winding or line-receiving area. Adjacent rollers in such a multi-roller configuration may be slightly offset from one another around the circumference of the drum so that the axial lengths of the rollers overlap one another to ensure that the rollers collectively cover the full axial length of the entire winding area of the drum.

Each roller 94 may be supported by two separate and distinct spring-loaded support brackets, as shown in the illustrated, or alternatively may be supported by a single spring-loaded support, for example a single bracket having a single spring-loaded pivotal connection to the draw-works at a position located generally centrally of the roller's length, and featuring a bifurcated arrangement that splits into two support arms each carrying a respective end of the roller.

Figure 17:
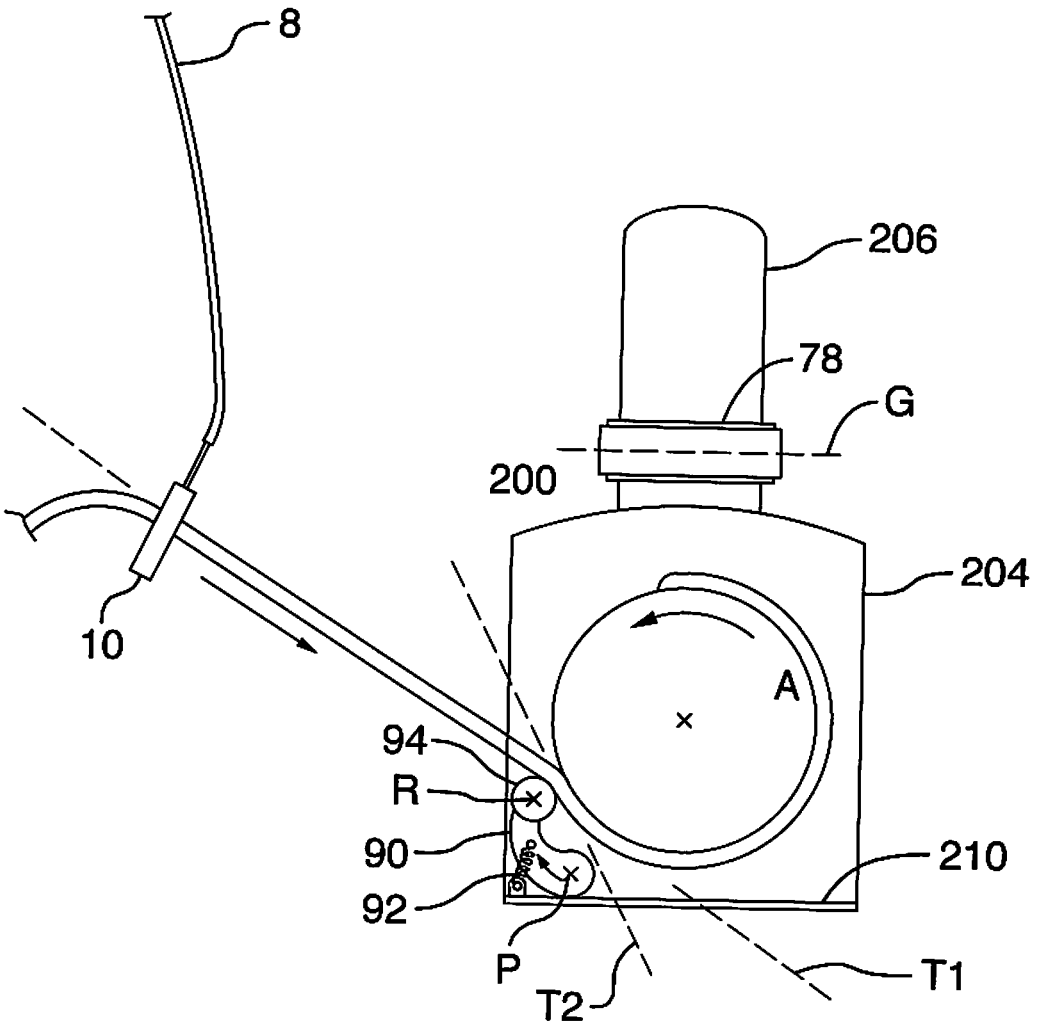
FIG. 17 schematically illustrates operation of a cable guide and the supplementary line tensioning assembly.

FIG. 17 schematically shows how the cable guide and supplementary line tensioning assembly 88 can cooperatively increase the tensioned state of the drill line. This may be achieved by routing the drill line, tensioned between the cable guide and the hoisting drum, along an inclined first tangent T1 of the periphery of the drum. The cylindrical roller 94 then impinges on the drill line at a location between the cable guide and the drum 200, which is typically closer to the drum than to the cable guide, to route the drill line along a second tangent T2 of the drum periphery that is oriented more upright compared to the first tangent. In other words, the tensioning roller 94 engages the drill line in a direction towards the periphery of the drum 200, so as to press the line in this direction, at a location on the drill line between the cable guide and the drum. In the manner described, the drill line may be tensioned even further. Note that the tensioning roller 94 may be used with the cable guide supported from the winch line 8 or supported on the track system 75 and carrier 78 so as to press the drill line against the periphery of the hoisting drum. In other embodiments, the tensioning roller 94 may be located at another quadrant of the hoisting drum depending on the distance of the cable guide from the drum and location thereof (e.g., suspended from the winch line 8 or on the track system 75) and offer similar functionality to the illustrated embodiment.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A cable guide for supporting a slack portion of a drill line of a drilling rig at an overhead position elevated above a draw-works of the drilling rig during a feeding of a new section of the drill line from a supply reel during a slip and cut operation in which a used section of the drill line is removed from the draw-works, the cable guide comprising:

a top body portion;

a bottom body portion fastened to the top body portion such that inner ends of the respective body portion are held in spaced relation facing one another;

at least one contact surface carried on each one of the top and bottom body portions;

a pair of the contact surfaces of the respective body portions being aligned in a working position so as to collectively define a pathway between the inner ends of the top and bottom body portions along which the slack portion of the drill line is to be routed;

an adjustable coupling mechanism arranged for displacing the inner ends of the top and bottom body portions towards and away from one another so as to adjust a size of the pathway.

2. The cable guide according to claim 1 wherein the top and bottom body portions form receptacles which are held in the spaced relation so as to face one another and the cable guide includes a pair of wear members removably received in the receptacles so as to be replaceable, at least one of the wear members comprising at least one groove defining said at least one contact surface.

3. The cable guide according to claim 2 wherein at least one of the wear members comprises a block having two main faces and a plurality of peripheral faces about a periphery of the block, said at least one groove of said at least one of the wear members being disposed in one of the peripheral faces and comprising a main groove portion curved inward of the peripheral face and edge groove portions along peripheral edges joining the main faces and the peripheral face, the edge groove portions being inclined between the respective main face and the main groove portion.

4. The cable guide according to claim 1 wherein at least one of the top body portion and the bottom portion comprises a body having opposing outward-facing surfaces on either side of a peripheral surface which supports the contact surface thereon, the contact surface comprising an intermediate contact portion and edge contact portions on each side thereof so as to be along edges joining each outward-facing surface and the peripheral surface, the edge contact portions being inclined between the respective outward-facing surface and the intermediate contact portion such that the contact surface has sloped transitions between the intermediate contact portion and the respective outward-facing surface.

5. The cable guide according to claim 1 wherein said at least one contact surface of at least one of the top body portion and the bottom body portion comprises a plurality of contact surfaces which are spaced about a periphery of said at least one of the respective body portions such that each one of the plurality of contact surfaces thereof are respectively positionable in the working position.

6. The cable guide according to claim 1 wherein one of the top body portion and bottom body portion comprises a roller carrying the at least one contact surface of said one of the top body portion and bottom body portion.

7. The cable guide according to claim 6 wherein another one of the top body portion and bottom body portion comprises a stationary block carrying the at least one contact surface of said another one of the top body portion and bottom body portion and the roller is rotatably supported so as to be rotatable relative to the block.

8. The cable guide according to claim 6 wherein said at least one contact surface of the roller comprises a groove.

9. The cable guide according to claim 6 wherein the top body portion comprises at least one coupler for hanging from a winch line of the drilling rig in the overhead position and the roller is received in the bottom body portion.

10. The cable guide according to claim 9 wherein said at least one coupler comprises two couplers each of which is attached at one of the top body portion and the bottom body portion so that the top and bottom body portions are supportable from the winch line at a generally common elevation.

11. The cable guide according to claim 1 wherein the adjustable coupling mechanism comprises a biasing assembly arranged for biasing the top and bottom body portions toward one another so as to effect clamping of the slack portion of the drill line between the pair of the contact surfaces thereby tensioning the drill line between the cable guide and the draw-works.

12. The cable guide according to claim 11 wherein the top and bottom body portions are fastened by threaded fasteners engaging a flange of at least one of the top and bottom body portions and respective receptacles of another one of the top and bottom body portions and the biasing assembly comprises a resilient element disposed on each fastener between a head thereof and the flange such that tightening of the fastener effects the clamping of the slack portion of the drill line.

13. The cable guide according to claim 11 further comprising a tension sensing device arranged to detect a tensioned state of the drill line between the cable guide and the draw-works.

14. The cable guide according to claim 13 wherein the top body portion comprises a coupler for hanging from a winch line of the drilling rig in the overhead position and the tension sensing device is disposed intermediate the coupler and the winch line.

15. The cable guide according to claim 13 wherein the tension sensing device comprises a load sensor disposed in one of the top and bottom body portions that is arranged for detecting clamping pressure between the top body portion and the bottom body portion.

16. The cable guide according to claim 1 in combination with the draw-works further comprising a support arrangement for holding the top and bottom body portions at a distance from a rotary drum of the draw-works that is supported for rotation about a drum axis for winding and playing out the drill line, the support arrangement including at least one horizontally oriented track which is elongate along the drum axis and spaced from the rotary drum and a carrier movably coupled to said at least one track that supports the top and bottom body portions in movement along said at least one track, wherein the carrier and said at least one track comprise cooperatively shaped channels in sliding engagement with one another which maintain the top and bottom body portions in a fixed angular orientation relative to the at least one track.

17. The cable guide according to claim 16 wherein the carrier comprises a tubular member slidably received over the at least one track and the carrier and said at least one track comprise common transverse cross-sections so as to maintain the fixed angular orientation of the top and bottom body portions.

18. The cable guide according to claim 1 in combination with the draw-works further comprising a support arrangement for holding the top and bottom body portions at a distance from a rotary drum of the draw-works that is supported for rotation about a drum axis for winding and playing out the drill line, the support arrangement including at least one horizontally oriented track which is elongate along the drum axis and spaced from the rotary drum and a carrier movably coupled to said at least one track that supports the top and bottom body portions in movement along said at least one track, wherein the at least one track is coupled to a housing of the draw-works that rotatably carries the rotary drum and the housing comprises a securing arrangement at or adjacent each end of the at least one track that is arranged for releasably securing at least one of the top and bottom body portions such that the body portions are prevented from moving along the at least one track.

19. A cable guide for supporting a slack portion of a drill line of a drilling rig at an overhead position elevated above a draw-works of the drilling rig during a feeding of a new section of the drill line from a supply reel during a slip and cut operation in which a used section of the drill line is removed from the draw-works, the cable guide comprising:

a body comprising a top body portion and a bottom body portion that are fastened to one another, the top and bottom body portions forming receptacles which are held in opposite relation to one another;

a pair of wear members received in the receptacles so as to be held in the opposite relation to one another;

at least one groove in at least one of the wear members;

a pair of the grooves of the opposing wear members being aligned in a working position so as to collectively define a pathway between the wear members along which the slack portion of the drill line is to be routed;

wherein said at least one groove of said at least one of the wear members comprises a plurality of grooves which are spaced about a periphery of said at least one of the wear members such that each one of the plurality of grooves thereof are respectively positionable in the working position.

20. A cable guide for supporting a slack portion of a drill line of a drilling rig at an overhead position elevated above a draw-works of the drilling rig during a feeding of a new section of the drill line from a supply reel during a slip and cut operation in which a used section of the drill line is removed from the draw-works, the cable guide comprising:

a body comprising a top body portion and a bottom body portion that are fastened to one another, the top and bottom body portions forming receptacles which are held in opposite relation to one another;

a pair of wear members received in the receptacles so as to be held in the opposite relation to one another to collectively define a pathway between the wear members along which the slack portion of the drill line is to be routed;

wherein one of the wear members comprises a stationary block;

wherein another one of the wear members comprises a roller which is rotatably supported by the respective one of the receptacles so as to be rotatable relative to the block.

* * * * *